US008086160B2

(12) United States Patent
Nishizawa et al.

(10) Patent No.: US 8,086,160 B2
(45) Date of Patent: Dec. 27, 2011

(54) FIXING APPARATUS, ROLLER FOR THE FIXING APPARATUS, FLEXIBLE SLEEVE FOR THE FIXING APPARATUS, AND METHODS OF MANUFACTURING THE ROLLER FOR THE FIXING APPARATUS AND THE FLEXIBLE SLEEVE FOR THE FIXING APPARATUS

(75) Inventors: Yuki Nishizawa, Susono (JP); Ken Nakagawa, Mishima (JP); Takaaki Akamatsu, Suntou-gun (JP); Shuuichi Tetsuno, Numazu (JP); Yuichi Yajima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 376 days.

(21) Appl. No.: 12/327,283

(22) Filed: Dec. 3, 2008

(65) Prior Publication Data

US 2009/0092426 A1 Apr. 9, 2009

Related U.S. Application Data

(63) Continuation of application No. PCT/JP2008/063460, filed on Jul. 18, 2008.

(30) Foreign Application Priority Data

Jul. 20, 2007 (JP) ..... 2007-189399

(51) Int. Cl.
*G03G 15/20* (2006.01)

(52) U.S. Cl. ..... 399/333
(58) Field of Classification Search ..... 399/333, 399/330
See application file for complete search history.

(56) References Cited

U.S. PATENT DOCUMENTS 6,175,699 B1 1/2001 Kato et al. ..... 399/69
6,459,878 B1 10/2002 Tomoyuki et al. ..... 399/331
(Continued)

FOREIGN PATENT DOCUMENTS

JP 9-11362 A 1/1997
(Continued)

OTHER PUBLICATIONS

International Preliminary Report on Patentability mailed Feb. 4, 2010, in counterpart International Patent Application No. PCT/JP2008/063460.

(Continued)

*Primary Examiner* — David Gray
*Assistant Examiner* — Laura Roth
(74) *Attorney, Agent, or Firm* — Fitzpatrick, Cella, Harper & Scinto

(57) ABSTRACT

A fixing roller has a base layer, a rubber layer formed on the base layer and a surface layer formed of a fluororesin tube, and a heater disposed inside the roller. The surface layer of the roller is formed by covering the fluororesin tube on the rubber layer in a condition where the fluororesin tube is pulled in a radial direction of the fluororesin tube, the fluororesin tube has an internal diameter less than an outer diameter of the roller and a thickness of 20 microns or smaller and a crystallization degree of the fluororesin tube being 50% or smaller. The roller is made by expanding the fluororesin tube is in a radial direction and drawing the fluororesin tube in a generatrix direction thereof, wherein a drawing ratio of the fluororesin tube in the drawing the fluororesin tube in the generatrix direction is 5% or smaller.

12 Claims, 17 Drawing Sheets

U.S. PATENT DOCUMENTS

| | | | | |
|---|---|---|---|---|
| 2002/0028099 | A1 | 3/2002 | Yamamoto et al. | 399/328 |
| 2002/0146259 | A1 * | 10/2002 | Zhou et al. | 399/333 |
| 2009/0092426 | A1 | 4/2009 | Nishizawa et al. | 399/331 |

FOREIGN PATENT DOCUMENTS

| | | | | |
|---|---|---|---|---|
| JP | 11-058552 | | | 3/1999 |
| JP | 11-58552 | A | | 3/1999 |
| JP | 11-058552 | A | | 3/1999 |
| JP | 11058552 | A | * | 3/1999 |
| JP | 2000-010430 | | | 1/2000 |
| JP | 2000-10430 | A | | 1/2000 |
| JP | 2000010430 | A | * | 1/2000 |
| JP | 2002-072737 | A | | 3/2002 |
| JP | 2002-72737 | A | | 3/2002 |
| JP | 2006-126576 | A | | 5/2006 |
| JP | 2007-093650 | | | 4/2007 |
| JP | 2007-093650 | A | | 4/2007 |
| JP | 2007-93650 | A | | 4/2007 |
| JP | 2007093650 | A | * | 4/2007 |

OTHER PUBLICATIONS

International Preliminary Report on Patentability dated Mar. 1, 2010, in counterpart International Patent Application No. PCT/JP2008/063460.

International Search Report and Written Opinion of PCT/JP2008/063460.

Korean Office Action mailed Apr. 18, 2011 in counterpart Korean patent application No. 10-2010-7003149.

Chinese Office Action dated Apr. 13, 2011, issued by the State Intellectual Property Office of the People's Republic of China, in counterpart Chinese Patent Application No. 200880024872.4.

* cited by examiner

FIXING APPARATUS, ROLLER FOR THE FIXING APPARATUS, FLEXIBLE SLEEVE FOR THE FIXING APPARATUS, AND METHODS OF MANUFACTURING THE ROLLER FOR THE FIXING APPARATUS AND THE FLEXIBLE SLEEVE FOR THE FIXING APPARATUS

This application is a continuation of International Application No. PCT/JP2008/063460, filed on Jul. 18, 2008, which claims the benefit of Japanese Patent Application No. 2007-189399 filed on Jul. 20, 2007.

BACKGROUND OF THE INVENTION

1. Field of the Invention

The present invention relates to a fixing apparatus mounted on an image forming apparatus such as an electrophotography printer or an electrophotography copying machine, a roller for a fixing apparatus and a flexible sleeve for the fixing apparatus used in the fixing apparatus. In addition, the present invention also relates to methods of manufacturing the roller for the fixing apparatus and the flexible sleeve for the fixing apparatus.

2. Description of the Related Art

A printer or a copying machine of the electrophotography type includes an image fixing apparatus for heat-fixing an unfixed toner image formed on a recording material thereonto. As a type of the fixing apparatus, there is a heat roller type including a fixing roller (roller for the fixing apparatus), a heat source such as a halogen heater disposed inside the fixing roller, and a pressure roller for forming a fixing nip portion together with the fixing roller. In addition, there are various types of fixing apparatus such as an on-demand type including an endless belt (hereinafter, also referred to as flexible sleeve for the fixing apparatus, fixing sleeve, or fixing film), a ceramic heater for contacting with an inner surface of the endless belt, and a pressure roller for forming a fixing nip portion together with the ceramic heater through the endless belt.

The fixing roller includes a roller core bar having high stiffness, and a rubber layer and a fluororesin layer formed on the core bar. This fixing roller has an advantage that high pressure can be applied to the recording material because of its high stiffness, and hence the fixing roller can be used suitably for a printer or a copying machine for high speed printing. In contrast, the fixing sleeve includes a resin film such as polyimide or a metal film such as a stainless steel, on which a rubber layer and a fluororesin layer are formed. The fixing sleeve has an advantage in that thermal capacity thereof can be reduced. The rubber layer is made of silicone rubber or the like, and has a role of improving its property of following pits and projections of the recording material or the toner image so that heat can be conducted uniformly to the toner image for achieving high image quality. The fluororesin layer has a role of preventing the toner having cohesiveness from sticking to and remaining on the surface of the fixing roller or the surface of the fixing sleeve.

Recently, in order to achieve high speed printing, to save power, and to improve image quality as for the printer, each type of the fixing apparatus including the heat roller type using the fixing roller and the on-demand type using the fixing sleeve is required to have higher efficiency for conducting heat to the recording material. Therefore, the fixing roller and the fixing sleeve are required to have high thermal conductivity, small thermal contact resistance with the toner image, i.e., high heat conduction efficiency from the heater to the toner image.

Therefore, the rubber layer is made of silicone rubber having high thermal conductivity and is formed to have an appropriate thickness. Thus, surfaces of the fixing roller and the fixing sleeve are adapted to have flexibility, and good property of following pits and projections of the recording material or the toner image is secured. As a result, the thermal contact resistance between the fixing roller and the recording material, as well as the thermal contact resistance between the fixing sleeve and the recording material can be reduced. In contrast, the fluororesin of the top surface layer has larger coefficient of elasticity and lower thermal conductivity than the silicone rubber. Therefore, the fluororesin layer can be formed as thin as possible for a purpose of securing the property of following and a purpose of improving the thermal conductivity. If the heat conduction efficiency from the heater to the toner image is high, a toner image can be fixed onto a surface of a recording material securely by the heat-fixing even in a printer for supporting high conveying speed of recording material. Therefore, it is possible to form an image having high quality with little density reduction or image loss even if the toner image is rubbed.

For the reason described above, to achieve a thinner fluororesin layer is pursued daily. Recently, a fluororesin tube having a thickness of approximately 30 microns has been developed.

If the fixing roller or the fixing sleeve formed of a rubber layer covered with a fluororesin tube is used for a long period of time, a minute crack may occur on a surface of the fluororesin layer (hereinafter, this crack is referred to as "crack in the fluororesin layer"). The crack in the fluororesin layer may cause an image defect when the toner image is fixed. In addition, if being further used, the fluororesin layer may rupture and drop out from the surface of the rubber layer, which may cause a problem that the fixing roller and the fixing sleeve cannot be used any more.

As a countermeasure of the crack in the fluororesin layer, a method of improving crack resistance property of the fluororesin is proposed. Patent Document 1 proposes a method of using a "copolymer of tetrafluoroethylene and perfluoromethylvinylether", or a "copolymer of tetrafluoroethylene and perfluoroethylvinylether" for the fluororesin. Patent Document 2 proposes a fixing apparatus in which a surface parting layer contains a copolymer of tetrafluoroethylene and perfluoroethoxyethylene, and transmittance of hydrochloric acid is $2.0\times10^{-5}$ g·cm/cm$^2$ or lower.

Patent Document 1: Japanese Patent Application Laid-Open No. H09-011362

Patent Document 2: Japanese Patent Application Laid-Open No. 2006-126576

SUMMARY OF THE INVENTION

However, it has found that if the thickness of the fluororesin tube covering the rubber layer is further reduced to be thinner than 30 microns, the crack described above may be apt to occur more. In particular, if the thickness of the tube made of fluororesin is reduced to be 20 microns or smaller, the crack may be apt to occur.

In order to solve the above-mentioned problem, the present invention provides a fixing apparatus comprising: a roller for the fixing apparatus comprising a base layer, a rubber layer formed on the base layer and a surface layer formed of a fluororesin tube; a heater disposed inside the roller for the fixing apparatus; and a pressure roller for forming a fixing nip portion for pinching and conveying a recording material bearing a toner image with the roller for the fixing apparatus, wherein the surface layer has a thickness of 20 microns or smaller and a crystallization degree of 50% or smaller.

Further, the present invention provides a roller for a fixing apparatus comprising a base layer, a rubber layer formed on the base layer and a surface layer formed of a fluororesin tube, wherein the surface layer has a thickness of 20 microns or smaller and a crystallization degree of 50% or smaller.

Further, the present invention provides a method of manufacturing a roller for a fixing apparatus comprising a base layer, a rubber layer formed on the base layer, a surface layer formed of a fluororesin tube, the surface layer having a thickness of 20 microns or smaller and a crystallization degree of 50% or smaller, the method comprising: covering a roller having the rubber layer formed on the base layer with a fluororesin tube having a thickness of 20 microns or smaller and an inner diameter smaller than an outer diameter of the roller having the rubber layer in a state where the fluororesin tube is expanded in a radial direction; and drawing the fluororesin tube covering the roller having the rubber layer in a generatrix direction thereof, wherein a drawing ratio of the fluororesin tube in the drawing the fluororesin tube in the generatrix direction is 5% or smaller.

Further, the present invention provides a fixing apparatus comprising: a flexible sleeve comprising a base layer, a rubber layer formed on the base layer and a surface layer formed of a fluororesin tube; a heater contacting with an inner peripheral surface of the flexible sleeve; and a pressure roller for forming a fixing nip portion for pinching and conveying a recording material bearing a toner image with the heater through the flexible sleeve, wherein the surface layer has a thickness of 20 microns or smaller and a crystallization degree of 50% or smaller.

Further, the present invention provides a flexible sleeve for a fixing apparatus comprising a base layer, a rubber layer formed on the base layer, and a surface layer formed of a fluororesin tube, wherein the surface layer has a thickness of 20 microns or smaller and a crystallization degree of 50% or smaller.

Further, the present invention provides a method of manufacturing a flexible sleeve for a fixing apparatus comprising a base layer, a rubber layer formed on the base layer, a surface layer formed of a fluororesin tube, the surface layer having a thickness of 20 microns or smaller and a crystallization degree of 50% or smaller, the method comprising: covering the flexible sleeve having the rubber layer formed on the base layer with a fluororesin tube having a thickness of 20 microns or smaller and an inner diameter smaller than an outer diameter of the flexible sleeve having the rubber layer in a state where the fluororesin tube is expanded in the radial direction; and drawing the fluororesin tube covering the flexible sleeve having the rubber layer in a generatrix direction thereof, wherein a drawing ratio of the tube in the drawing the fluororesin tube in the generatrix direction is 5% or smaller.

According to the present invention, even if the thickness of the resin tube as a surface layer covering the rubber layer is reduced, a crack hardly occurs in the surface layer.

Further features of the present invention will become apparent from the following description of exemplary embodiments with reference to the attached drawings.

DESCRIPTION OF REFERENCE SYMBOLS

1 fixing roller
1*b* rubber layer (elastic layer)
1*c* resin tube (surface layer)
113 fixing sleeve
113*b* rubber layer (elastic layer)
113*c* resin tube (surface layer)

DESCRIPTION OF THE EMBODIMENTS

The present invention is described with reference to the attached drawings.

Embodiment 1

Figure 1:
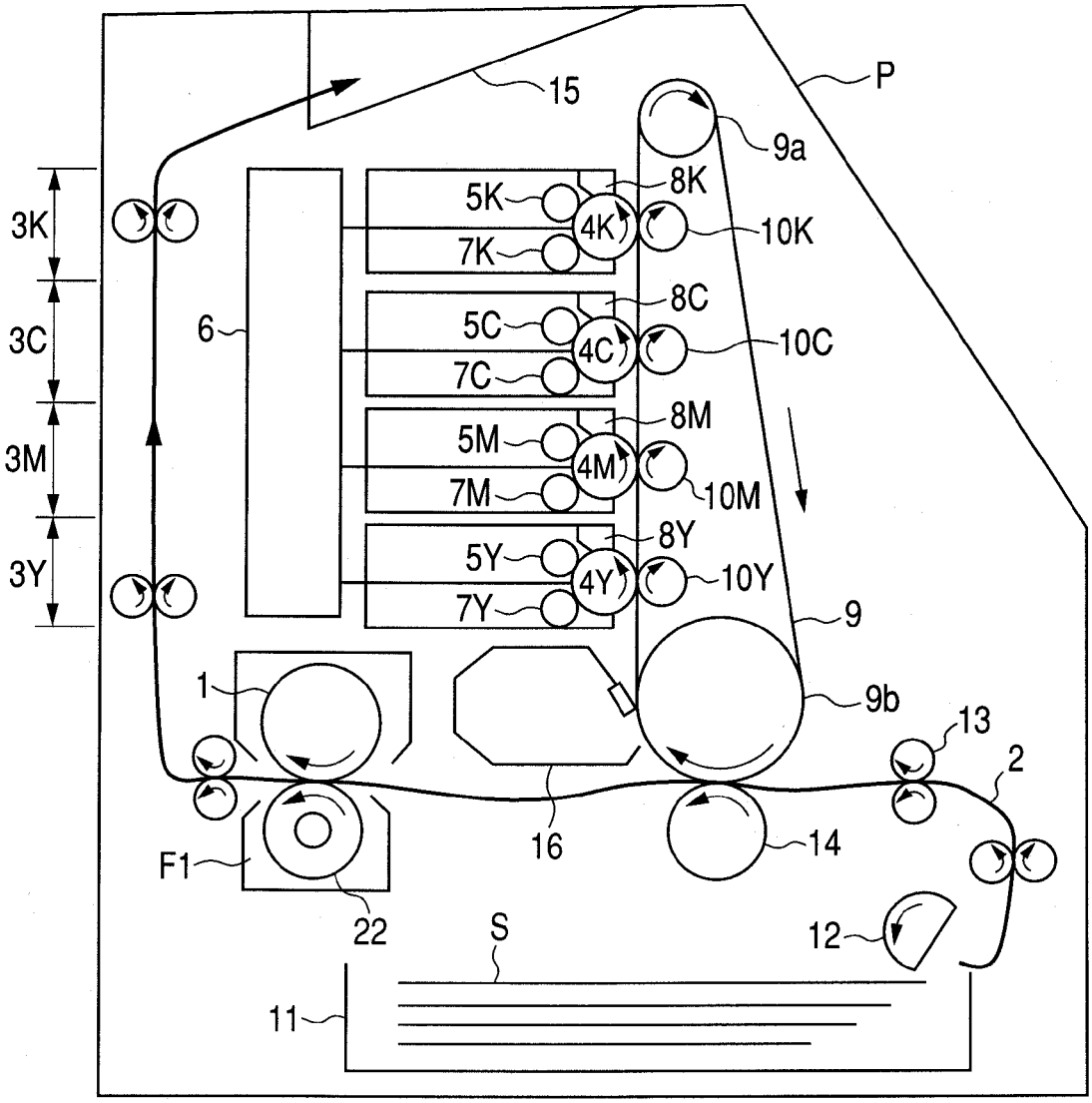
FIG. 1 is a structural model diagram of an example of an image forming apparatus.

FIG. 1 is a structural model diagram of an example of an image forming apparatus on which a fixing apparatus including a roller for the fixing apparatus according to the present invention can be mounted. The image forming apparatus is an electrophotography type full color laser printer, which supports the A3 size and the Ledger size. This image forming apparatus supports a conveying speed of recording materials (sheets) at 120 mm/sec. In addition, throughput in printing on a plain paper as the recording material is 11 ppm for Ledger longitudinal feed and 22 ppm for LTR lateral feed.

As for an order of description, an entire structure of an image forming apparatus P is described first, and then a structure of a fixing apparatus F1, a structure of a fixing roller 1 and a method of manufacturing the same are described.

(Image Forming Apparatus)

The image forming apparatus P described in this embodiment includes a conveying path 2 for recording materials S and four image forming stations 3Y, 3M, 3C, and 3K arranged substantially linearly in a substantially vertical direction with respect to the conveying path 2. Among the four image forming stations 3Y, 3M, 3C, and 3K, the image forming station 3Y forms an image of yellow (hereinafter referred to as Y) color. The image forming station 3M forms an image of magenta (hereinafter referred to as M) color. The image forming station 3C forms an image of cyan (hereinafter referred to as C) color. The image forming station 3K forms an image of black (hereinafter referred to as K) color.

The individual image forming stations 3Y, 3M, 3C, photosensitive members (hereinafter referred to as photosensitive drums) 4Y, 4M, 4C, and 4K as image bearing members, and charging rollers 5Y, 5M, 5C, and 5K as the charge means, respectively. In addition, the individual image forming stations 3Y, 3M, 3C, and 3K include an exposure device 6 as the exposure means, developing devices 7Y, 7M, 7C, and 7K as the developing means, and cleaning devices 8Y, 8M, 8C, and 8K as the cleaning means. In the image forming process, the photosensitive drum 4Y of the image forming station 3Y is rotated in the arrow direction of FIG. 1. First, the outer peripheral surface (surface) of the photosensitive drum 4Y is charged by the charging roller 5Y uniformly. The charged surface on the surface of the photosensitive drum 4Y is irradiated with a laser beam corresponding to image information from the exposure device 6 and is exposed so as to form an electrostatic latent image. The latent image is visualized by the developing device 7Y using Y toner so as to be a Y toner image. Thus, the Y toner image is formed on the surface of the photosensitive drum 4Y. Similar image forming process is performed also in each of the image forming stations 3M, 3C, and 3K. Thus, an M toner image is formed on the surface of the photosensitive drum 4M, a C toner image is formed on the surface of the photosensitive drum 4C, and a K toner image is formed on the surface of the photosensitive drum 4K.

An endless intermediate transfer belt 9, which is disposed along the arrangement direction of the image forming stations 3Y, 3M, 3C, and 3K, is hung and stretched between a drive roller 9*a* disposed above the image forming station 3Y and a driven roller 9*b* disposed below the image forming station 3Y. The drive roller 9*a* rotates in the arrow direction of FIG. 1. Thus, the intermediate transfer belt 9 is turned and moved along the individual image forming stations 3Y, 3M, 3C, and 3K at a speed of 120 mm/sec. Toner images of individual colors are transferred and overlaid one by one on the outer peripheral surface (surface) of the intermediate transfer belt 9 by primary transfer means 10Y, 10M, 10C, and 10K disposed to be opposed respectively to the photosensitive drums 4Y, 4M, 4C, and 4K through the intermediation of the transfer belt 9. Thus, a full color toner image (including four colors) is formed on the surface of the intermediate transfer belt 9.

After the primary transfer process, transfer remaining toner on the surface of each of the photosensitive drums 4Y, 4M, 4C, and 4K is removed by the cleaning blade (not shown) provided to the cleaning devices 8Y, 8M, 8C, and 8K. Thus, the photosensitive drums 4Y, 4M, 4C, and 4K can be used for the next image formation.

On the other hand, the recording materials S, which are stacked and housed in a feed cassette 11 disposed at the lower portion of the image forming apparatus P, are separated and fed one by one from the feed cassette 11 by a feed roller 12 so as to be sent to a registration roller pair 13. The registration roller pair 13 sends out the fed recording material S to a transferring nip portion between the intermediate transfer belt 9 and a secondary transfer roller 14 disposed so as to be opposed to the driven roller 9*b* through the intermediation of the transfer belt 9. A bias from a high voltage power supply (not shown) is applied to the secondary transfer roller 14 when the recording material S passes through the transferring nip portion. Thus, the full color toner image is secondarily transferred from the surface of the intermediate transfer belt 9 to the recording material S passing through the transferring nip portion. The recording material S bearing the toner is conveyed to the fixing apparatus F1. The recording material S is heated and pressed when it passes through the fixing apparatus F1, and the toner image is fixed on the recording material S by a heat-fixing process. Then, the recording material S is delivered from the fixing apparatus F1 to a deliver tray 15 outside the image forming apparatus P.

After the secondary transferring, transfer remaining toner on the surface of the intermediate transfer belt 9 is removed by a cleaning blade (not shown) provided to an intermediate transfer belt cleaning device 16. Thus, the intermediate transfer belt 9 can be used for the next image formation.

(Fixing Apparatus)

In the following description, for the fixing apparatus and members constituting the fixing apparatus, a longitudinal direction is a direction perpendicular to a recording material conveyance direction on the surface of the recording material. A transverse direction is a direction parallel to the recording material conveyance direction on the surface of the recording material. A width indicates size in the transverse direction.

Figure 2:
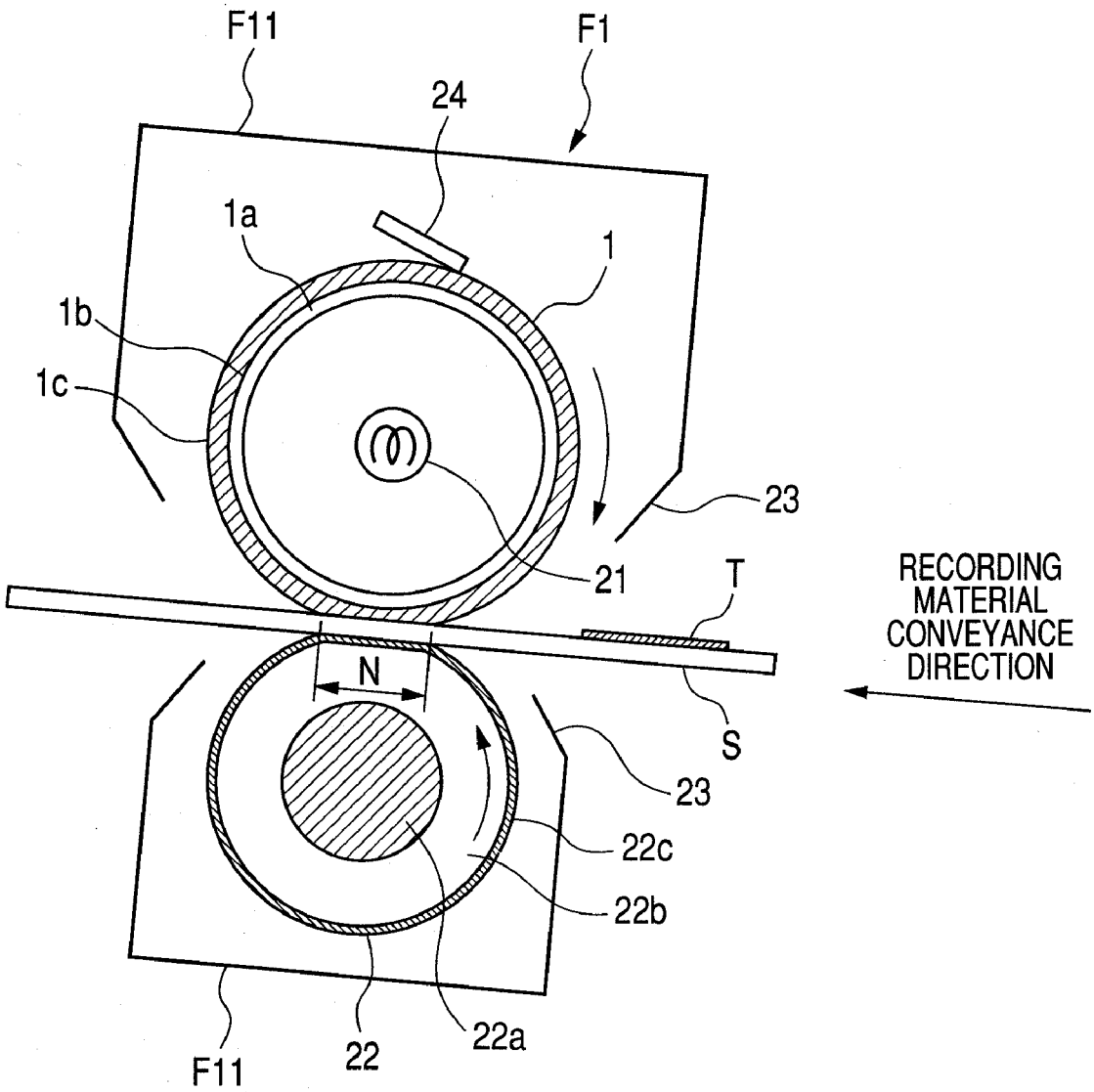
FIG. 2 is a structural model diagram illustrating a cross section of an example of a fixing apparatus according to Embodiment 1.

FIG. 2 is a structural model diagram illustrating a cross section of an example of the fixing apparatus F1 including the roller for the fixing apparatus.

The fixing apparatus F1 includes a fixing roller 1 as the roller for the fixing apparatus, a halogen lamp 21 as a heating body (heat source), a device frame F11 including a pressure roller 22 and an inlet guide 23, a temperature control thermistor (temperature detection means) 24, and the like. Each of the fixing roller 1, the halogen lamp 21, and the pressure roller 22 is an elongated member in the longitudinal direction. An outer diameter of the fixing roller 1 is R=50ϕ (mm), and an outer diameter of the pressure roller 22 is 45ϕ (mm).

The fixing roller 1 includes a core bar (base layer) 1*a* that is a hollow roller made of aluminum having a thickness of 3 mm. The halogen lamp 21 is inserted and disposed in the inner space (inside) of the core bar 1*a*. The core bar 1*a* receives heat of the halogen lamp 21 by conduction and radiation. Then, the core bar 1*a* raises temperature of the outer peripheral surface (surface) of the fixing roller 1 to a predetermined temperature by the heat conduction through an elastic layer 1*b* and a surface layer 1*c* described later. Silicone rubber having a thickness of 2 mm as the elastic layer (hereinafter referred to as rubber layer) 1*b* is provided to the outer periphery of the core bar 1*a* so as to cover the core bar 1*a*. Further, on the outer periphery of the rubber layer 1*b*, a resin tube made of PFA (copolymer of tetrafluoroethylene and perfluoroalkylvinylether) having a thickness of 20 microns as the surface layer 1*c* is coated so as to cover the rubber layer 1*b*. In other words, a fluororesin tube as the surface layer is coated on the elastic layer. The fixing roller 1 is supported at both ends of the core bar 1*a* by fore-and-aft side plates (not shown) of the device frame F11 in a rotatable manner. In addition, the halogen lamp 21 is supported at both ends of the halogen lamp 21 by the fore-and-aft side plates of the device frame F11.

The pressure roller 22 includes a core bar 22*a*, an elastic layer (hereinafter referred to as rubber layer) 22*b* made of silicone rubber disposed around the core bar 22*a*, and a PFA parting layer 22*c* as a top surface layer disposed around the rubber layer 22*b*. This pressure roller 22 is supported at both ends of the core bar 22*a* by the fore-and-aft side plates of the device frame F11 in a rotatable manner.

The fixing roller 1 and the pressure roller 22 are pressed by a pressure spring (not shown) by total pressure of 686N (70 kgf) so that the outer peripheral surface (surface) of the fixing roller 1 contacts with the outer peripheral surface (surface) of the pressure roller 22. The pressure makes the surface of the fixing roller 1 contact with the surface of the pressure roller 22, and hence a nip portion (fixing nip portion) N having a width of approximately 8.0 to 9.0 mm is obtained between the surface of the fixing roller 1 and the surface of the pressure roller 22.

The pressure roller 22 is driven to rotate at a predetermined circumferential speed in the arrow direction by drive means (not shown). On this occasion, the pressure friction force between the surface of the pressure roller 22 and the surface of the fixing roller 1 at the nip portion N causes a rotation force exerting on the fixing roller 1. The fixing roller 1 is driven by the rotation force to rotate in the arrow direction. Electric power is supplied to the halogen lamp 21 from a power supply (not shown). Thus, the halogen lamp 21 generates heat, and heats the fixing roller 1.

The temperature control thermistor 24 detects temperature of the surface of the fixing roller 1, and the detection signal is received by power control means. The power control means controls power supply to the halogen lamp 21 on the basis of the detection signal so that the temperature of the surface of the fixing roller 1 is maintained to be a predetermined temperature (target temperature).

When the rotation of the pressure roller 22 and the fixing roller 1 becomes stabilized and the temperature of the surface of the fixing roller 1 is maintained to be the predetermined temperature, the recording material S bearing the unfixed toner image T is conveyed in the arrow direction and is led to the nip portion N. The recording material S is pinched between the surface of the pressure roller 22 and the surface of the fixing roller 1 at the nip portion N and is conveyed at a speed of 120 mm/sec. In the conveying process, heat of the fixing roller 1 and pressure of the nip portion N are applied to the recording material S, and hence the toner image T is fixed on the surface of the recording material S by the heat-fixing process.

(Fixing Roller)

Conventionally, two methods (1) and (2) described below are known as a method of forming the rubber layer on the core bar and forming the fluororesin layer on the rubber layer for the fixing roller.

(1) A method of applying liquid fluororesin coating onto the rubber layer and baking the same.

(2) A method of preparing a fluororesin tube having an inner diameter smaller than an outer diameter of a rubber roller, applying adhesive having low viscosity to the inner peripheral surface of the fluororesin tube and the outer peripheral surface of the rubber roller, and covering the rubber roller with the fluororesin tube while enlarging (expanding) the diameter of the fluororesin tube. In this method, the adhesive between the inner peripheral surface of the fluororesin tube and the outer peripheral surface of the rubber roller is made to work as a lubricant.

Comparing with the method (1), the method (2) does not require to heat the rubber layer up to rubber heat resistance temperature or higher. In addition, adhesiveness between the rubber layer and the fluororesin layer is sufficient, and hence the quality is stable and film uniformity of the fluororesin layer is high, which is advantageous. Therefore, the method (2) was used for manufacturing the fixing roller 1 in this embodiment.

Hereinafter, methods of manufacturing the fixing roller 1 are described in detail.

FIGS. 3A to 3C, 4, and 5A to 5C are diagrams illustrating a method of manufacturing the fixing roller 1.

Figure 3A:
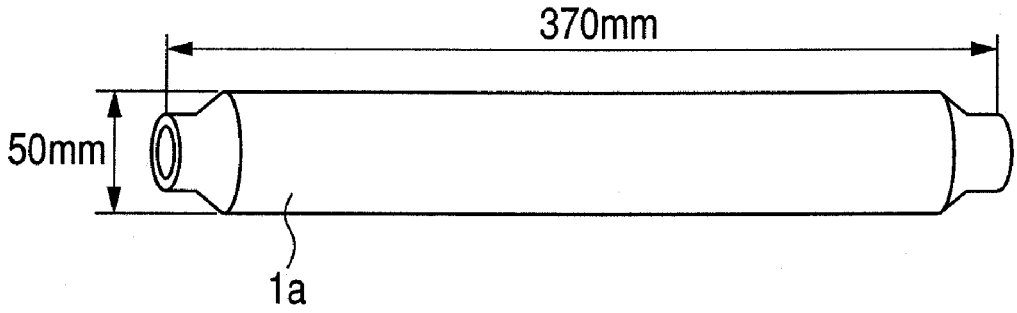
FIG. 3A is a first diagram (1) illustrating a method of manufacturing a fixing roller.
Figure 3B:
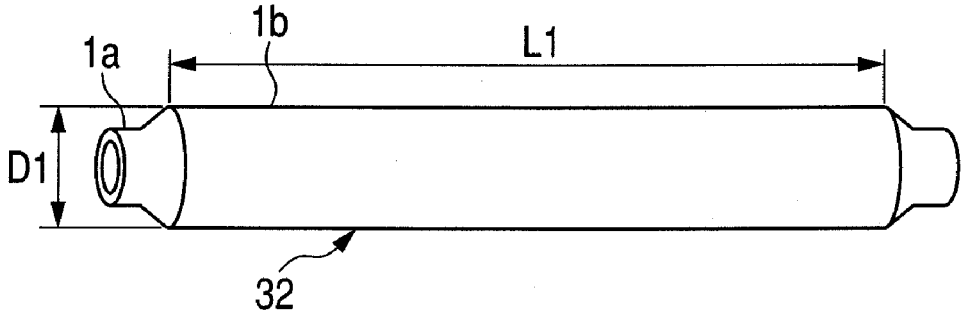
FIG. 3B is a first diagram (2) illustrating the method of manufacturing the fixing roller.
Figure 3C:
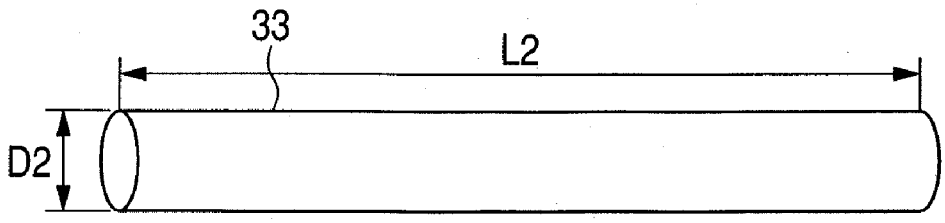
FIG. 3C is a first diagram (3) illustrating the method of manufacturing the fixing roller.

First, the outer peripheral surface (surface) of the core bar 1*a* made of hollow aluminum having a longitudinal length of 370 mm, an outer diameter of 50 mm, and a thickness of 3.0 mm illustrated in FIG. 3A is cleaned with a solvent, and a primer process is performed thereon. Then, hot vulcanization (HTV) type silicone rubber is coated on the surface of the core bar 1*a* by ring coating, and the silicone rubber is heated and cured so as to obtain a roller 32 having the rubber layer (elastic layer) 1*b* of a straight cylindrical shape with uniform outer diameter along the axial direction (FIG. 3B). Then, adhesive (not shown) is applied to the entire region of the outer peripheral surface (surface) of the rubber layer 1*b* of the roller 32. As the adhesive, heat curing adhesive (TSE-3221 manufactured by TOSHIBA Silicone Co., Ltd.) is used. As illustrated in FIG. 3B, outer diameter D1 of the roller 32 is 50.0 mm, and length L1 in the axial direction of the rubber coated portion is 313 mm. A cylindrical fluororesin tube 33 illustrated in FIG. 3C has an inner diameter D of 48.7 mm and a length L2 of 350 mm in the axial direction, the inner diameter D2 being smaller than the outer diameter D1 of the roller 32. The fluororesin tube 33 is a fluororesin tube obtained by extrusion molding (manufactured by Gunze Limited). This fluororesin tube 33 has a thickness of 20 microns.

Figure 4:
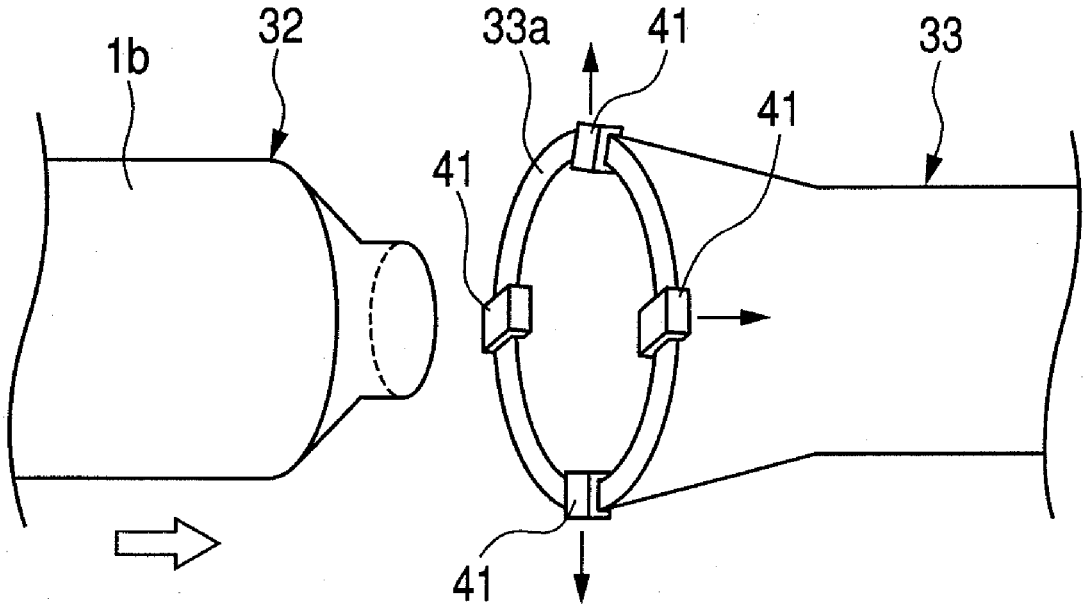
FIG. 4 is a second diagram illustrating a method of manufacturing the fixing roller.

As illustrated in FIG. 4, four chucks 41 are attached to an end portion 33*a* of the fluororesin tube 33 (hereinafter also referred to as tube simply) with equal intervals in the circumferential direction on the end portion 33*a*. The chucks 41 attached to the tube 33 are pulled equally in the radial direction of the tube 33 so as to expand the diameter of the tube 33 while the roller 32 coated with adhesive is inserted into the tube 33 so that the tube 33 covers the entire surface of the roller 32. On this occasion, the diameter of the tube 33 is expanded by approximately 2.7% compared with before the expansion. Then, the insertion force when the roller 32 is inserted is 2 kg.

Thus, in the above-mentioned step, the roller 32 including the core bar 1*a* and the rubber layer 1*b* formed on the surface of the core bar 1*a* is covered with the fluororesin tube 33 having the thickness of 20 microns and the inner diameter smaller than the outer diameter of the roller 32 by expanding the fluororesin tube 33 in the radial direction thereof.

Figure 5A:
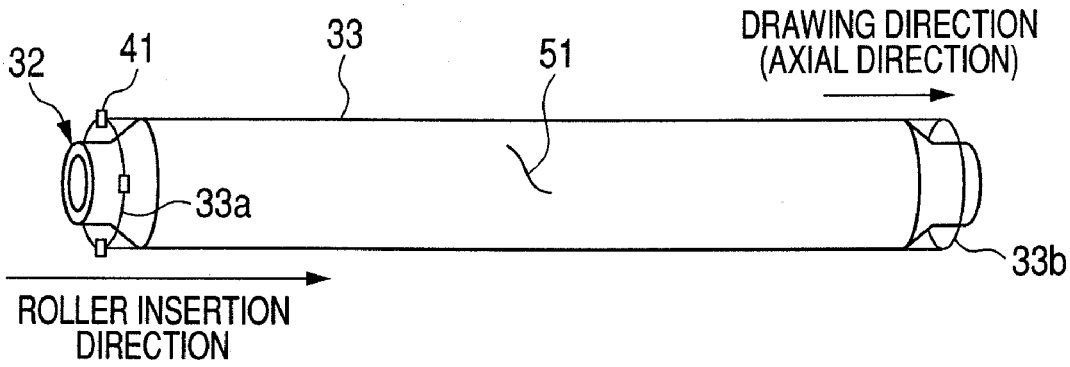
FIG. 5A is a third diagram (1) illustrating a method of manufacturing the fixing roller.
Figure 5B:
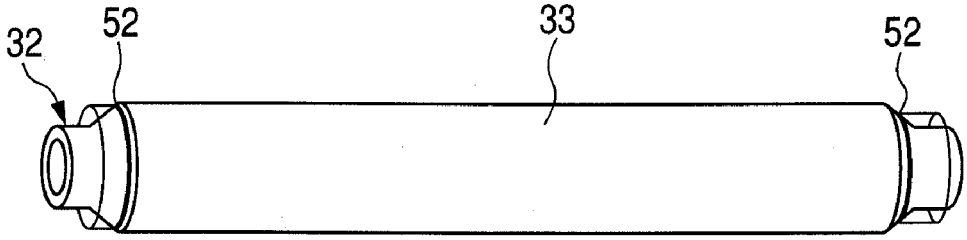
FIG. 5B is a third diagram (2) illustrating the method of manufacturing the fixing roller.
Figure 5C:
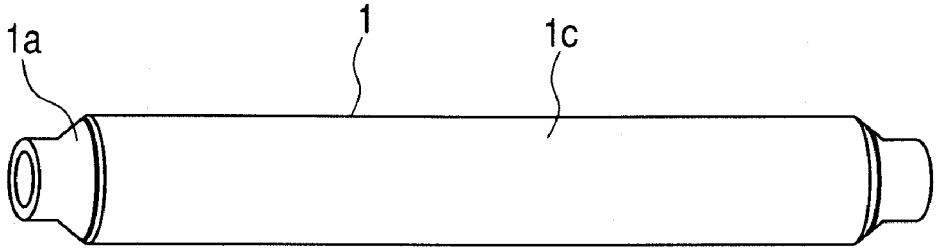
FIG. 5C is a third diagram (3) illustrating the method of manufacturing the fixing roller.

When the step of covering the entire surface of the roller 32 with the tube 33 is performed, the tube 33 has a redundant length at each end in the axial direction (hereinafter also referred to as generatrix direction) of the roller 32 as illustrated in FIG. 5A. Then, one end portion 33*a* of the tube 33 is fixed with the chuck 41. In this state, the other end 33*b* of the tube 33 is pulled by 17.5 mm in the generatrix direction of the roller 32 from the opposite direction to the chuck 41, and hence a wrinkle 51 generated on the outer peripheral surface (surface) of the tube 33 is smoothed. Hereinafter, the step of drawing the tube in the generatrix direction is referred to as an axial drawing step. In this embodiment, a pulling amount in the step of drawing the fluororesin tube 33 in the axial direction is set to 17.5 mm. The pulling amount 17.5 mm of this fluororesin tube 33 corresponds to 5% of the longitudinal length of the fluororesin tube 33 that is 350 mm. Next, as illustrated in FIG. 5B, the both redundant end portions 52 of the tube 43 are welded by heat, and the adhesive is cured by heating for five minutes at 200 degrees centigrade. At the end, the redundant portions of the tube 43 are cut so that the fixing roller 1 is obtained as illustrated in FIG. 5C.

Thus, in the above-mentioned axial drawing step, the resin tube 33 is drawn in the generatrix direction of the roller 32 so that the wrinkle 51 generated on the surface of the resin tube 33 is smoothed. The drawing ratio of the resin tube 33 is 5%. The drawing ratio is calculated as "(((resin tube length after drawing)−(resin tube length before drawing))/resin tube length before drawing)×100(%)".

(Fluororesin Tube)

The fluororesin tube 33 used in the fixing roller 1 of this embodiment is described.

Figure 6A:
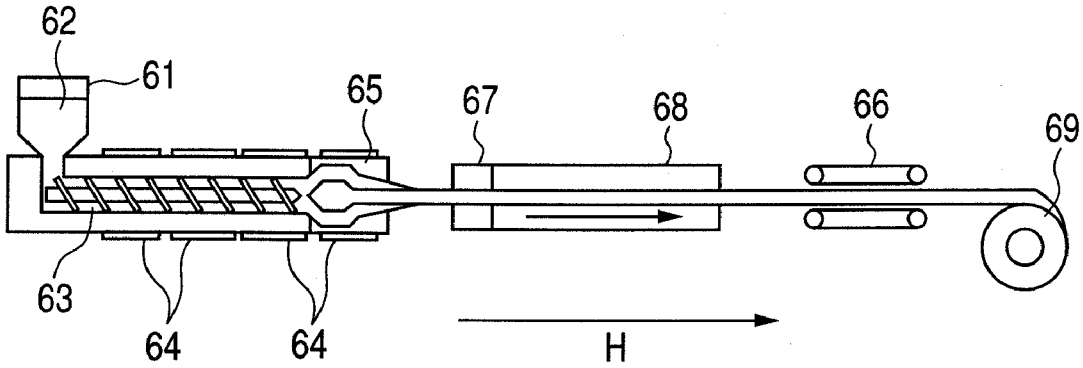
FIG. 6A is a diagram (1) illustrating a method of manufacturing a fluororesin tube.
Figure 6B:
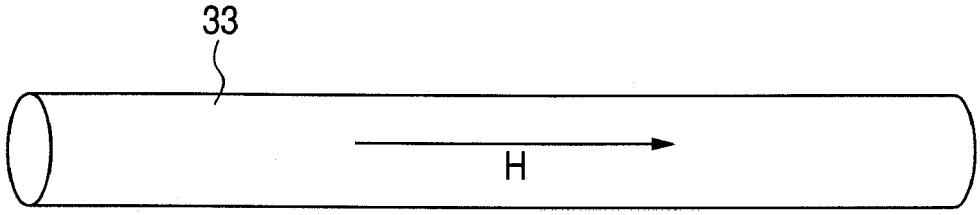
FIG. 6B is a diagram (2) illustrating the method of manufacturing the fluororesin tube.

FIGS. 6A and 6B are diagrams illustrating the method of manufacturing the fluororesin tube 33.

The fluororesin tube 33 is manufactured by using a melt extruder illustrated in FIG. 6A. The manufacturing process are roughly divided into steps of material supplying, heat melting, extruding, sizing, cooling, taking off, winding, and cutting. First, in the material supplying step, PFA pellets (manufactured by DU PONT-MITSUI FLUOROCHEMICALS COMPANY, LTD., Teflon 451HP-J) 62 as the material of the fluororesin tube 33 are introduced into a hopper 61. Next in the heat melting step, the PFA pellets are sent out by a screw 63 while they are heated by a heater 64 up to a melting temperature of 350 degrees centigrade. Next in the extruding step, the PFA is extruded in a tube-like shape from a die 65 (die/mandrel diameters: 70/66 mm). Next, the extruded PFA is taken off by a taking off machine 66 at a taking off speed of 4.0 m/min in the arrow direction, which enters a sizing die 67 having an outer diameter of 48.7 mm so as to be sized into a cylinder having a thickness of 20 microns and an outer diameter of 48.7 mm. After that, it is cooled through a cooling apparatus 68, is wound by a winding apparatus 69, and is cut at a desired length.

(Relationship Between Crack in Fluororesin Layer of Fixing Roller and Image Defect)

Next, a "crack in the fluororesin layer (surface layer)" is described with reference to FIGS. 7A and 7B.

Figure 7A:
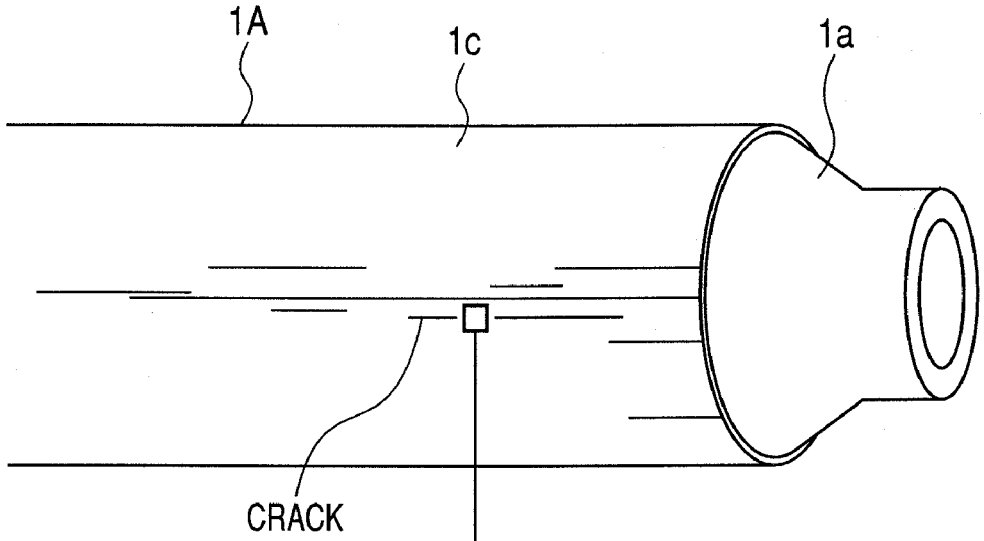
FIG. 7A is a diagram illustrating a fixing roller having a crack generated in a fluororesin layer.

FIG. 7A is a diagram illustrating an end portion of the fixing roller having a crack generated in a fluororesin layer 1*c* serving as the surface layer. For discrimination from the fixing roller 1 of this embodiment, the fixing roller illustrated in FIG. 7A is denoted by reference symbol 1A. The fixing roller 1A illustrated in FIG. 7A has the same structure as that of the fixing roller 1 of this embodiment except for a crack generated in the fluororesin layer 1*c*.

The crack generated in the fluororesin layer 1*c* of the fixing roller 1A is very thin and always extends in the longitudinal direction of the roller 32. A length of the crack in the longitudinal direction varies from 1 mm or shorter to 50 mm or longer.

Figure 7B:
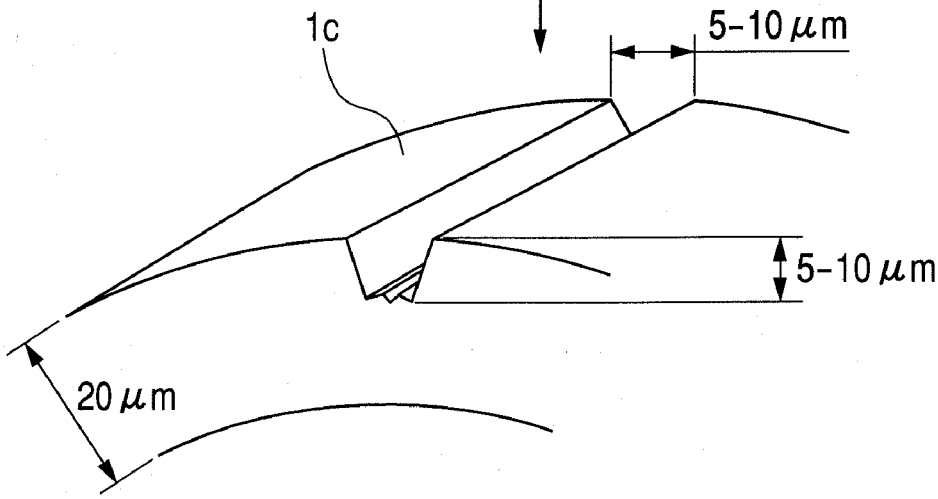
FIG. 7B is an enlarged diagram of a part of the fixing roller illustrated in FIG. 7A.

FIG. 7B is an enlarged diagram of the cross section of the fluororesin layer 1*c* in which the crack has occurred. When the fluororesin tube 33 has a thickness of 20 microns, the crack has a width of approximately 5 to 10 microns and a depth of approximately 5 to 10 microns.

Figure 8:
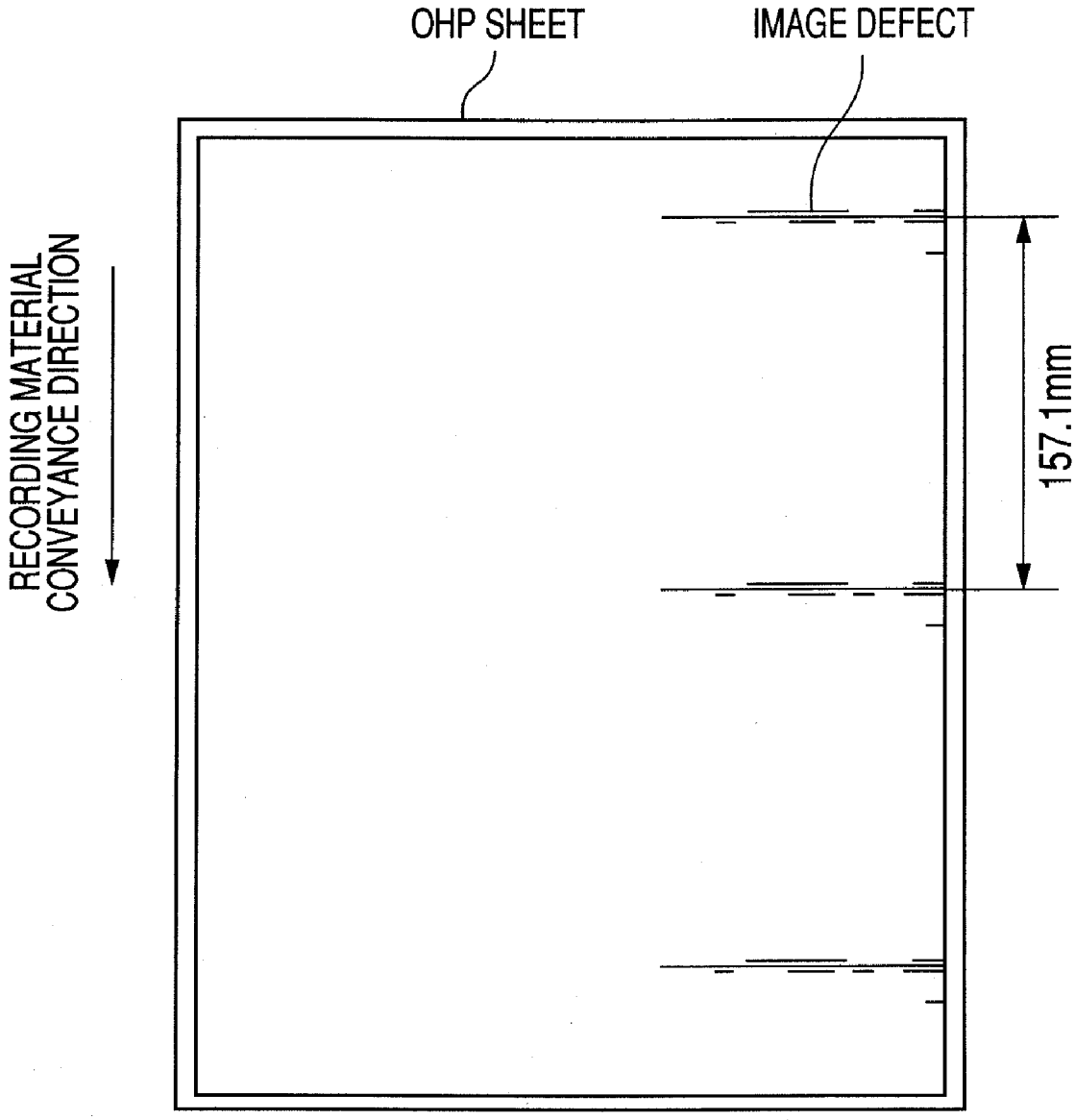
FIG. 8 is a diagram illustrating a state of occurrence of an image defect.

FIG. 8 is a diagram illustrating a state of occurrence of an image defect in an output of the image by using the image forming apparatus including the fixing apparatus F1 having the fixing roller 1A having a crack generated in the fluororesin layer 1*c*. An image pattern of the output image is a solid image having the entire surface filled with yellow color, and the recording material S for printing the output image is a sheet for an OHP.

The image defect printed on the OHP sheet has a thin line like a hairline generated at the position corresponding to the crack generated on the surface of the fixing roller 1A, and the same pattern is repeated every rotation of the fixing roller 1A. The fixing roller 1A has an outer diameter of 50 mm, and hence the pattern of the image defect is repeated every interval of one circumference 157.1 mm. This thin line has a tendency of being conspicuous in a solid image or the like having much toner. In addition, this thin line becomes conspicuous in the case where glossiness of the toner surface is high or in the case where the OHP sheet that is transparent for light is used. If the fixing roller 1A is continuously used in the state with the thin line, the fluororesin layer (fluororesin tube 33) 1*c* is entirely ruptured so that the surface of the rubber layer 1*b* is exposed at the end. If the surface of the rubber layer 1*b* is exposed, toner adheres to the surface of the rubber layer 1 at the exposed portion, thereby blotting a print image to make a serious image defect. In addition, if the fluororesin tube 33 is lacking completely, adhesiveness between the OHP sheet and the fixing roller 1A increases. In other words, the OHP sheet is apt to wind around the fixing roller 1A, which may cause a problem of occurrence of paper jamming.

(Causes of Occurrence of Crack on the Fluororesin Layer)

Next, causes of occurrence of a crack in the fluororesin layer 1*c* of the fixing roller 1A are described.

It was found by the inventors of the present invention that there are two points (1) and (2) described below that cause the "crack in the fluororesin layer" generated in the fixing roller 1A.

(1) Orientational crystallization of the fluororesin.

(2) Mechanical stress exerted on the fluororesin.

First, the orientational crystallization of the fluororesin as the point (1) is described.

The orientational crystallization means the phenomenon in which an interatomic force or a hydrogen bond works between polymer molecular chains when a degree of orientation of the polymer molecular chain is extremely enhanced, and crystallization in the orientational direction forms a tiny-fiber structure. The polymer molecular chain crystallized in the orientational direction so as to form the tiny fiber structure has high strength and coefficient of elasticity in the orientational direction while it has a dynamically weak structure in the direction perpendicular to the orientational axis. In addition, surface property of the resin of tiny fibers may be deteriorated, which may cause degradation of chemical resistance.

Factors of promoting the orientational crystallization as described above are included in both the manufacturing process of the fluororesin tube and the manufacturing process of the fixing roller.

First, a reason why the manufacturing process of the fluororesin tube promotes the orientational crystallization is described.

In order to obtain a thin fluororesin tube 33 in the manufacturing process of the fluororesin tube illustrated in FIG. 6A, it is the most effective to increase the taking off speed of the fluororesin tube in the extruded and melted state so as to increase the drawing magnification. When the drawing magnification is increased, the polymer molecular chain of the fluororesin is oriented strongly in the direction of the arrow H. Therefore, the manufactured fluororesin tube 33 has the orientational crystallization in the direction of the arrow H illustrated in FIG. 6B, and hence it has a dynamically-weak structure in the direction perpendicular to the arrow H (circumferential direction of fluororesin tube 33).

As illustrated in FIG. 7A, the crack occurs so as to extend in the longitudinal direction of the roller 32 because the orientational direction of the polymer of the fluororesin tube matches the longitudinal direction of the roller 32. Therefore, the fluororesin tube 33 is twisted in the manufacturing process of the fixing roller so that the longitudinal direction of the roller 32 does not match the orientational direction of the polymer of the fluororesin tube 33. In this case, it is confirmed that the crack of the fluororesin layer 1*c* occurs along the orientational direction of the polymer of the fluororesin tube 33. In this manufacturing process of the fluororesin tube 33, means for relieving the orientational crystallization includes decreasing the taking off speed so that the drawing magnification is lowered, and raising the melting temperature of the fluororesin so as to increase its flowability.

Next, the reason why the orientational crystallization is promoted in the manufacturing process of the fixing roller is described.

In the manufacturing process of the fixing roller illustrated in FIGS. 5A to 5C, if the fluororesin tube 33 is made to be thin, it is difficult to cover it over uniformly so that the wrinkle 51 is apt to occur. Therefore, it is necessary to pull the fluororesin tube 33 strongly in the direction illustrated in FIG. 5A so that the wrinkle 51 is smoothed. However, if the fluororesin tube 33 having high degree of orientation is pulled in the orientational direction, the orientational crystallization may be promoted only by a slight amount of pulling. Therefore, it is necessary to decide an absolute value of the tube expansion amount in the axial drawing step on the basis of results of a crystallization degree, an endurance test and an accelerated test that are described later, and hence as to control the absolute value with an accuracy within a tolerances of ±1 mm or smaller.

Next, the mechanical stress exerted on the fluororesin as the point (2) is described.

In FIG. 2, in order to drive two rollers including the fixing roller 1 and the pressure roller 22 that is press-contacts with the fixing roller 1, the pressure roller 22 is driven to rotate by utilizing a drive system (drive means) including a drive motor, gears and the like. The other opposed fixing roller 1 is driven to rotate in the arrow direction by a friction force exerted on the nip portion N where the fixing roller 1 contacts with the pressure roller. When being driven to rotate, the core bar 1*a* of the fixing roller 1 is not deformed, but the rubber layer 1*b* is deformed by the pressure exerted by the pressure roller 22. The deformation amount is apt to be larger if the thickness of the rubber layer 1*b* is large and the pressure from the pressure roller 22 is strong. On this occasion, the fluororesin layer 1*c* as the surface layer is deformed following a shape of the rubber layer 1*b* and receives the strong mechanical stress so as to repeat expansion and compression in the direction perpendicular to the orientational crystallization direction of the fluororesin tube 33 (dynamically-weak direction). In addition, since torque when the rotation of the fixing roller 1 starts is larger than the torque in the steady rotation, the fluororesin layer 1*c* receives the friction force in the dynamically-weak direction, which is particularly large when the rotation starts, and hence as to receive a strong mechanical stress.

In other words, every time when the fixing roller 1 is rotated or starts to rotate, the stress in the dynamically-weak direction is repeated with respect to the thinned fluororesin tube 33. When going out from the nip, the force is released, which is repeated every time when the fixing roller 1 rotates. When this is repeated many times, the fluororesin layer 1*c* is ruptured so that the crack occurs.

In the case of the fixing apparatus F1 of this embodiment, and if life of the main body of the image forming apparatus is 100,000 sheets of paper print, the number of times of starting the rotation of the fixing roller is 100,000 at maximum, and the number of rotations is 1000,000 or larger at maximum. Therefore, the fluororesin layer 1*c* of the fixing roller 1 is required to have high flex strength. The life of the main body of the image forming apparatus means a range of the number of printable sheets under the condition of assuring usability and image quality. As to the main body of the image forming apparatus, the usability means frequency of occurrence of jamming, sound noise, electromagnetic noise and the like, for instance. The image quality means accuracy of position, color reproducibility, tone unevenness, a glossy on the image surface, and other general image defects. Therefore, the crack in the fluororesin layer must not occur at least before the end of life of the main body of the image forming apparatus.

(Evaluation)

In order to check the effect of the image forming apparatus equipped with the fixing apparatus F1 including the fixing roller 1 according to this embodiment, toner fixability (indicator of efficiency of heat conduction to toner), the presence or absence of occurrence of the crack after the endurance (indicator of endurance of fixing roller), and the crystallization degree are evaluated.

First, details of the evaluation method are described in detail.

(Evaluation Method of Toner Fixability)

A scrubbing test is used for evaluating how strongly the toner is fixing to the paper, which becomes an indicator of the efficiency of heat conduction to the toner.

First, by using the fixing apparatus F1 according to this embodiment, an image for evaluating the fixability is fixed to 50 sheets continuously under the conditions of environment at temperature of 10 degrees centigrade and humidity of 50% and the input voltage of 120 volts. As the sheets, LETTER size XEROX 4024 sheets (90 g/m$^2$ manufactured by XEROX Corporation) are used. The image for evaluating the fixability is an image in which 5×5 mm patch image (with reflection density of 0.7 to 0.8) made up of 2×2 dots checker flag half tone patterns are disposed at nine portions in the sheet.

After printing, predetermined ordinal numbers (first, tenth, twelfth and fiftieth) of samples are extracted from the fifty sheets. A weight of predetermined weight (200 grams) is put on the image forming surface of the sample through Shirubonshi (trade name) paper, and in this state the image forming surface is rubbed in a reciprocating manner five times. Before and after the rubbing, reflection density of the image is measured. The measurement of the reflection density was performed by using Gretag Macbeth RD918 (trade name). A ratio of density decrease was calculated as ((density before rubbing)−(density after rubbing))/(density before rubbing)×100(%). The ratio of density decrease is 0% when the fixability is best, i.e., the image for evaluation is not scrubbed at all. On the contrary, the ratio of density decrease is 100% when the fixability is worst, i.e., the image for evaluation is scrubbed completely. The larger the ratio of density decrease, the worse the fixability is.

As to an index of a value of the toner fixability, in the environment at temperature of 10 degrees centigrade and humidity of 50%, if the ratio of density decrease is 40%, the toner image may drop off from the sheet under the normal use environment. In the environment at temperature of 10 degrees centigrade and humidity of 50%, if the ratio of density decrease is 30%, the density decrease of the toner image may occur when the image surface is rubbed under the normal use environment. In the environment at temperature of 10 degrees centigrade and humidity of 50%, if the ratio of density decrease is 20% or lower, a problem such as the density decrease does not occur under the normal use environment. Therefore, as to the conclusion of this evaluation, a worst value of the ratios of density decrease of the image at nine portions in the sheet is determined, and it is decided to be good if the worst value is smaller than 20% while it is decided to be not good if the worst value is 20% or larger (see "fixability (%)" in Table 1).

(Evaluation Method of Crack after Endurance Test)

Using the image forming apparatus, printing of two sheets with an interval is repeated until reaching 100,000 sheets that is the life of the main body of the apparatus. The method of printing two sheets with an interval is performed as follows. After printing on two sheets of the transferring material (paper), the printing job is stopped. Then, after the drive system such as the drive motor has stopped, printing on another two sheets of the transferring material is performed. Those steps are repeated until reaching 100,000 sheets that corresponds to the life of the main body of the image forming apparatus, while image check is performed every 10,000 sheets. As to the printing of two sheets with an interval, LETTER sized XEROX 4024 sheets (75 g/m$^2$, manufactured by XEROX Corporation) were used as the transferring material. As the image pattern, a lattice pattern of single black color with a print ratio of 1% was used. As for the image check performed every 10,000 sheets, LETTER sized HP COLOR LASER JET PRINTER TRANSPARENCY FILMS (manufactured by Hewlett-Packard Development Company, L.P.) were used as the transferring material. As the image pattern, a solid image of single yellow color with a print ratio of 100% was used. As the image evaluation method, the presence or absence of the image defect on hairlines is checked by a visual inspection. As illustrated in Table 1 as the "result of endurance", the case without occurrence of the image defect is concluded to be "acceptance" while the case with occurrence of the image defect is concluded to be "rejection".

(Evaluation Method of Crystallization Degree)

As for evaluation of the orientational crystallization degree, it is effective to measure the crystallization degree by X-ray diffraction. In this evaluation, a powder X-ray diffraction apparatus (manufactured by Rigaku Corporation, a sample horizontal type high-intensity X-ray diffraction apparatus "RINT TTRII") was used for evaluating the crystallization degree. In addition, the calculation of the crystallization degree is performed by using analyzing software "JADE6" attached to the apparatus. Note that the crystallization degree obtained by this measurement can be calculated by using the equation (I) below.

$$\text{Crystallization degree}=Ic/(Ic+Ia)\times 100 \quad \text{(I)}$$

Ic is crystalline scattering intensity (area)

Ia is amorphous scattering intensity (area)

The fluororesin tube as a measurement sample is cut out to be a rectangular shape with a width of approximately 2 cm and a length of approximately 3 cm. The cut out measurement piece was fixed to a non-reflection sample plate (manufactured by Rigaku Corporation) without a diffraction peak within the measurement range by pasting both ends of the measurement piece with adhesive tape so that the tube does not sag (so that the adhesive tape is not in the area of the X-ray projection).

Figure 9:
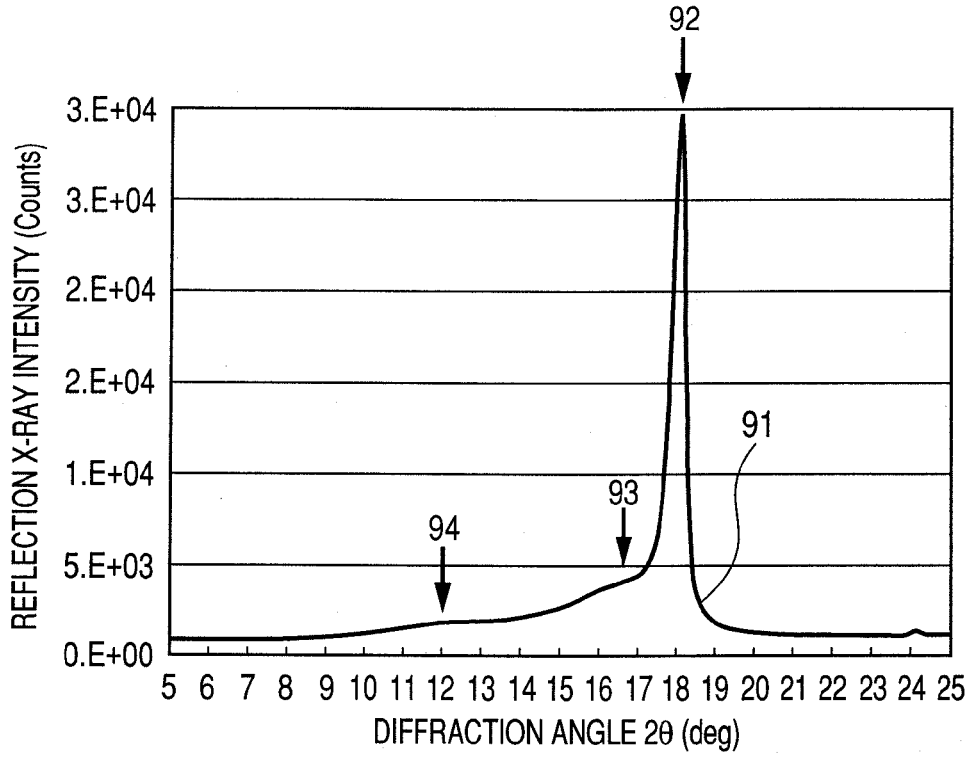
FIG. 9 is a graph illustrating data of crystallization degree measured by a powder X-ray analysis apparatus.

(Conditions of Measurement)

tube: Cu collimated beam optical system voltage: 50 kV current: 300 mA start angle: 5 degrees end angle: 25 degrees sampling width: 0.02 degrees scan speed: 4.00 degrees/min divergence slit: open divergence vertical slit: 10 mm scattering slit: open light receiving slit: open FIG. 9 illustrates data obtained by this measurement. The horizontal axis represents X-ray incident angle 2θ (deg), and the vertical axis represents intensity (counts) of the detected reflection X-ray. The data curve 91 of FIG. 9 indicates a relationship between the reflection X-ray intensity and the X-ray incident angle 2θ (deg) which are obtained from the fixing roller including the tube having a thickness of 15 microns. First, a peak separation process is performed with respect to the obtained peak by using the software "JADE6" attached to the apparatus. For instance, if the obtained peak is derived from only the fluororesin, the peak separation process can be performed after a sharp crystalline peak 92 at the vicinity of 2θ=18 degrees and a broad amorphous peak 93 having a summit at the vicinity of 2θ=16 to 18 degrees are designated and then an automatic fitting operation can be performed. Substituting the area of the crystalline peak and the area of the amorphous peak obtained by the operation described above into the equation (I), the crystallization degree can be calculated.

Note that if a peak other than the peak of the target fluororesin exists within the measurement range, the crystallization degree is calculated by using only the areas of the crystalline peak and the amorphous peak derived from the fluororesin after an appropriate peak separation is performed with respect to every peak. As to the fixing roller 1 of this embodiment, a peak 94 derived from rubber having a summit at the vicinity of 2θ=11 to 13 degrees may occur depending on a thickness of the fluororesin tube 33. If the peak 94 occurs in the evaluation of this embodiment, the evaluation of the crystallization degree was performed as follows.

All the crystalline peak 92 at the vicinity of 2θ=18 degrees, the amorphous peak 93 at the vicinity of 2θ=16 to 18 degrees and the peak 94 derived from rubber are designated in the software "JADE6". Then, the software "JADE6" performs the automatic fitting operation with respect to the three peaks, and hence the crystalline peak area, the amorphous peak area and the rubber-derived peak area are calculated. In this calculation, the crystalline peak area and the amorphous peak area are substituted into the equation (I) without using the rubber-derived peak area for the calculation equation, and hence the crystallization degree of the fluororesin can be obtained.

<Evaluation Result>

Hereinafter, the samples of the embodiments and the comparison examples used for the evaluation are described in detail.

Total seventeen types of samples were manufactured. First, in the manufacturing process of the fluororesin tubes, they are manufactured as for four types of parameters (2.7 mm/sec, 3.2 mm/sec, 4.0 mm/sec and 5.0 mm/sec) of the tube taking off speed. As a result, there were four tube thicknesses including 30 microns, 25 microns, 20 microns and 15 microns. Multiple samples were manufactured for each thickness of the tube by changing the axial drawing quantity (%). In addition, the axial drawing quantity in the manufacturing process of the samples was set to an axial drawing quantity (%) such that the wrinkle can be smoothed appropriately in the manufacturing process or a lower value. The details are as follows.

As to a tube thickness of 15 microns, the axial drawing quantity (%) such that the wrinkle can be smoothed appropriately in the manufacturing process was 10%. Therefore, the manufactured samples include five types of 2%, 3%, 4%, 6% and 10%.

As to a tube thickness of 20 microns, the axial drawing quantity (%) such that the wrinkle can be smoothed appropriately in the manufacturing process was 8%. Therefore, the manufactured samples include seven types of 1%, 2%, 3%, 4%, 5%, 6% and 8%.

As to a tube thickness of 25 microns, the axial drawing quantity (%) such that the wrinkle can be smoothed appropriately in the manufacturing process was 5%. Therefore, the manufactured samples include three types of 1%, 3% and 5%.

As to a tube thickness of 30 microns, the axial drawing quantity (%) such that the wrinkle can be smoothed appropriately in the manufacturing process was 4%. Therefore, the manufactured samples include two types of 2% and 4%.

Detailed setting of total seventeen types of samples, and the fixability evaluation result and the endurance property evaluation result thereof are illustrated in Table 1.

The samples from Embodiment 1-1 to Embodiment 1-7 have thicknesses of the resin tube of 20 microns or smaller and crystallization degrees of the resin tube of 50% or smaller. The samples from Comparison Example 1-1 to Comparison Example 1-10 have thicknesses of the resin tube of 20 microns or larger, or crystallization degrees of 50% or larger.

As to the fixability of the tube thickness of 15 microns and the 20 microns, the evaluation of the fixability (i.e., the ratio of density decrease) is smaller than 20(%), and the conclusion is "acceptance". As to the tube thickness of 25 microns and that of 30 microns, the evaluation of the fixability (i.e., ratio of density decrease) is larger than 20(%), and the conclusion is "rejection". In other words, it indicates that the efficiency of heat conduction to the toner is improved by making the tube thin.

The "acceptance" and the "rejection" concerning the result of endurance indicate results of the durability test. The result "acceptance" indicates that a crack did not occur in the fluororesin layer (i.e., the surface layer of the fixing roller) during the life of the main body of the image forming apparatus. The result "rejection" indicates that a crack occurred. According to the results, the samples from the Embodiment 1-1 to the Embodiment 1-7 satisfy both the "acceptance" concerning the fixability and the "acceptance" concerning the endurance property.

Figure 10:
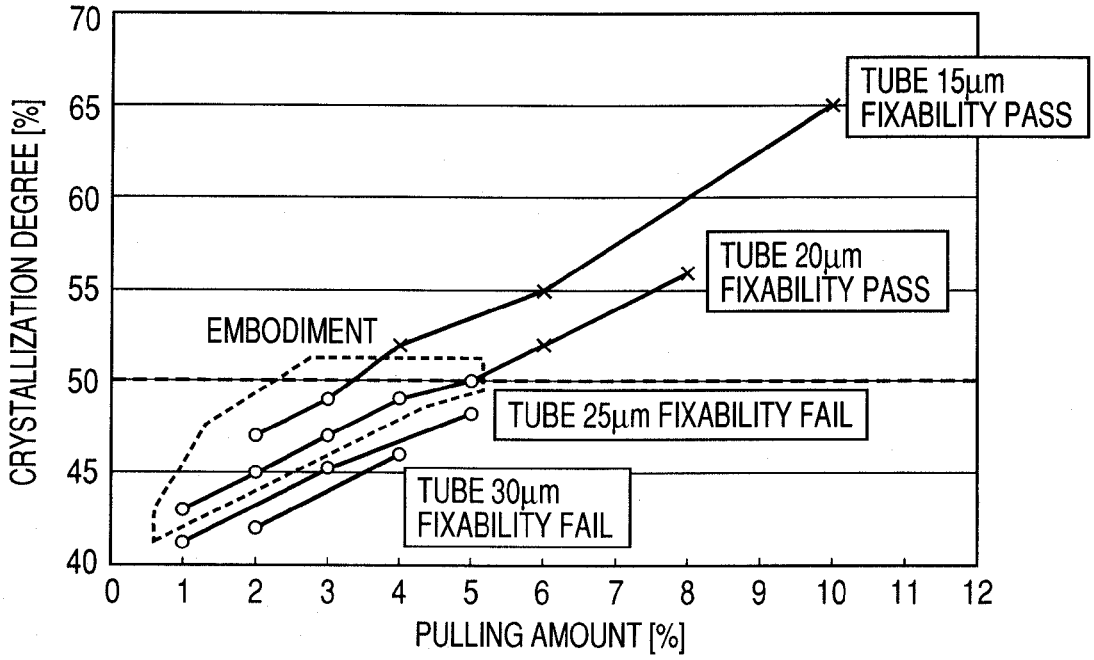
FIG. 10 is a graph illustrating evaluation results of fluororesin tube samples.

FIG. 10 illustrates a graph of the results. The horizontal axis of the graph indicates a pulling amount (%) of the fluororesin tube in the axial drawing step, and the vertical axis of the graph indicates a crystallization degree (%). The plot lines are classified by the tube thicknesses of 15 microns, 20 microns, 25 microns and 30 microns for convenience sake.

In FIG. 10, each of the lines concerning the tube thicknesses of 15 microns, 20 microns, 25 microns and 30 microns indicates a tendency of monotonic increase, i.e., a tendency in which the crystallization degree increases as the fluororesin tube is pulled more in the axial drawing step. In addition, it is understood that there is a tendency of the crystallization degree increasing as the drawing magnification is increased so as to make the fluororesin tube thin.

It is understood from this evaluation result that control of the orientational crystallization of the fluororesin so as to make the fixing roller having the crystallization degree of 50% or smaller is effective for preventing occurrence of the crack in the fluororesin layer.

As to the fixing roller 1 of this example, a concrete method of controlling the crystallization degree to be 50% or smaller is to control the pulling amount of the fluororesin tube 33 in the axial drawing step to be 5% or smaller in a case of a tube thickness of 20 microns. Furthermore, in a case of a tube

TABLE 1

| | taking off speed (m/min) | tube thickness (μm) | axial direction drawing (%) | crystallization degree (%) | fixability (%) | result of endurance |
|---|---|---|---|---|---|---|
| Embodiment 1-1 | 5.0 | 15 | 2 | 47 | 14 (acceptance) | acceptance |
| Embodiment 1-2 | 5.0 | 15 | 3 | 49 | 13 (acceptance) | acceptance |
| Comparative Example 1-1 | 5.0 | 15 | 4 | 52 | 15 (acceptance) | rejection |
| Comparative Example 1-2 | 5.0 | 15 | 6 | 55 | 14 (acceptance) | rejection |
| Comparative Example 1-3 | 5.0 | 15 | 10 | 65 | 13 (acceptance) | rejection |
| Embodiment 1-3 | 4.0 | 20 | 1 | 43 | 18 (acceptance) | acceptance |
| Embodiment 1-4 | 4.0 | 20 | 2 | 45 | 17 (acceptance) | acceptance |
| Embodiment 1-5 | 4.0 | 20 | 3 | 47 | 16 (acceptance) | acceptance |
| Embodiment 1-6 | 4.0 | 20 | 4 | 49 | 18 (acceptance) | acceptance |
| Embodiment 1-7 | 4.0 | 20 | 5 | 50 | 17 (acceptance) | acceptance |
| Comparative Example 1-4 | 4.0 | 20 | 6 | 52 | 18 (acceptance) | rejection |
| Comparative Example 1-5 | 4.0 | 20 | 8 | 56 | 16 (acceptance) | rejection |
| Comparative Example 1-6 | 3.2 | 25 | 1 | 41 | 26 (rejection) | acceptance |
| Comparative Example 1-7 | 3.2 | 25 | 3 | 45 | 25 (rejection) | acceptance |
| Comparative Example 1-8 | 3.2 | 25 | 5 | 48 | 23 (rejection) | acceptance |
| Comparative Example 1-9 | 2.7 | 30 | 2 | 42 | 36 (rejection) | acceptance |
| Comparative Example 1-10 | 2.7 | 30 | 4 | 46 | 34 (rejection) | acceptance |

thickness of 15 microns, the method is to control the pulling amount of the fluororesin tube 33 in the axial drawing step to be 3% or smaller.

In addition, it is desirable to control the crystallization degree to be within the range of 43 to 50% if it is considered sufficiently to suppress the occurrence of a wrinkle on the tube.

Furthermore, in order to control the crystallization degree to be 50% or smaller while suppressing occurrence of a wrinkle on the tube, it is desirable to control the pulling amount of the fluororesin tube 33 in the axial drawing step to be within the range of 1% to 5% in the case of the tube thickness of 20 microns. In addition, it is desirable to control the pulling amount of the fluororesin tube 33 in the axial drawing step to be within the range of 2% to 3% in the case of the tube thickness of 15 microns.

Note that although the drawing ratio in the appropriate axial drawing step for controlling the crystallization degree of the tube to be 50% or smaller while suppressing a wrinkle depends on a difference of the fluororesin tube other than the thickness, the suppression of a wrinkle and the control of the crystallization degree to be substantially within an appropriate range can be achieved if the drawing ratio is set to be within the range of 1% to 5% in the case of the fluororesin tube having the thickness of 20 microns or smaller.

As described above, a good fixability can be obtained by controlling the thickness of the resin tube 33 to be 20 microns or smaller, and occurrence of the crack in the fluororesin layer 1*c* through the endurance can be prevented by controlling the crystallization degree to be 50% or smaller. Therefore, the fixing roller 1 having both high heat conduction efficiency and high endurance property can be provided.

Embodiment 2

In this embodiment, an example of a fixing apparatus including a flexible sleeve for the fixing apparatus according to the present invention is described. The image forming apparatus equipped with this fixing apparatus is an electrophotography type color laser printer which supports A4 and Letter sizes. This image forming apparatus has a conveying speed of recording material (sheets) at 47 mm/sec. In addition, throughput in printing on a plain sheet as the recording material is 8 ppm for feeding Letter size sheets in the lateral direction. The image forming apparatus has the same structure as that of Embodiment 1 except for the fixing apparatus F1. Therefore, the same components as those in the image forming apparatus of Embodiment 1 are denoted by the same reference symbols, and overlapping descriptions thereof will be omitted.

(Fixing Apparatus)

Figure 11:
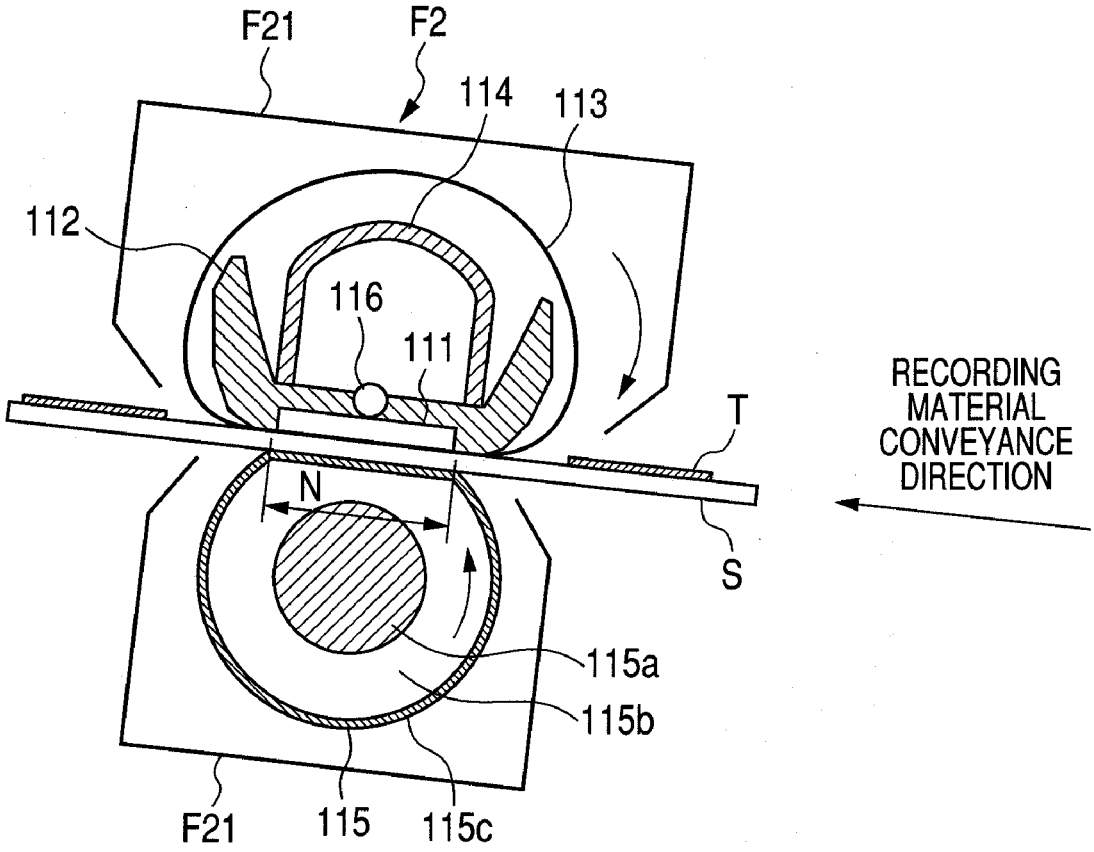
FIG. 11 is a model diagram illustrating a cross section of an example of a fixing apparatus according to Embodiment 2.

FIG. 11 is a model diagram illustrating a cross section of an example of a fixing apparatus F2 including the sleeve for the fixing apparatus.

The fixing apparatus F2 includes a heater 111 as the heating body (heat source), a heater holder 112 as the heating body holding member, a fixing sleeve 113 as the flexible sleeve for the fixing apparatus, and a reinforcing stay 114. In addition, the fixing apparatus F2 includes a pressure roller 115, a device frame F21, and a temperature control thermistor (temperature detection means) 116. Each of the heater 111, the heater holder 112, the fixing sleeve 113, the reinforcing stay 114, and the pressure roller 115 is an elongated member in the longitudinal direction.

The heater holder 112 is formed to be like a gutter having a cross section of substantially a semicircular shape by using a predetermined heat resistance material, and supports the heater 111 in a groove portion disposed on the lower surface thereof at the middle portion in the width direction along the longitudinal direction. This heater holder 112 is supported by the fore-and-aft side plates (not shown) of the device frame 21 at both end portions of the heater holder 112.

The heater 111 is a ceramic heater including a substrate made of aluminum nitride elongated in the longitudinal direction, and a resistance heating element and glass coating formed on the substrate. The resistance heating element and the glass coating (protecting layer) for protecting the resistance heating element are formed on the front side of the aluminum nitride substrate (side close to the fixing sleeve 113). On the other hand, a thermistor 116 is provided to the back side of the aluminum nitride substrate (side close to the heater holder 112). The substrate of the heater 111 is fixed to the groove portion of the heater holder 112 and is supported by the same by exposing the resistance heating element side of the substrate downward from the groove portion of the heater holder 112.

The fixing sleeve 113 is formed of a thin cylindrical film having flexibility and heat resistance property. This fixing sleeve 113 engages with the outer periphery of the heater holder 112 loosely.

The reinforcing stay 114 includes a U-shaped stiff member having a cross section opening downward. This reinforcing stay 114 is disposed at the middle of the heater holder 112 in the width direction.

The pressure roller 115 includes a core bar 115*a*, an elastic layer (hereinafter, referred to as rubber layer) 115*b* made of silicone rubber provided to the periphery of the core bar 115*a*, and a PFA parting layer 115*c* as a top surface layer provided to the periphery of the rubber layer 115*b*. This pressure roller 115 is supported by the fore-and-aft side plates of the device frame F21 at both end portions of the core bar 115*a* in a rotatable manner.

The reinforcing stay 114 and the pressure roller 115 are pressed by a pressure spring (not shown) by a total pressure 156.8 N (16 kgf) so that the outer peripheral surface (surface) of the fixing sleeve 113 contacts with the outer peripheral surface (surface) of the pressure roller 115. The pressure enables the surface of the fixing sleeve 113 to contact with the surface of the pressure roller 115 so that a predetermined width of the nip portion (fixing nip portion) N is obtained between the surface of the fixing sleeve 113 and the surface of the pressure roller 115.

The pressure roller 115 is driven by the drive means (not shown) to rotate at a circumferential speed of 47 mm/sec in the arrow direction. On this occasion, a pressure friction force between the surface of the pressure roller 115 and the surface of the fixing sleeve 113 at the nip portion N enables the rotation force to work on the fixing sleeve 113. The fixing sleeve 113 is driven to rotate around the heater holder 112 in the arrow direction in such a manner that the inner peripheral surface (inner surface) of the fixing sleeve 113 contacts with the glass coating of the heater 111 on the substrate surface side and slides on the same by the rotation force thereof. Fluorine-based grease (MOLYKOTE HP-300 grease manufactured by Dow Corning Toray Co., Ltd.) is applied as a lubricant (not shown) to the inner surface of the fixing sleeve 113, so as to secure sliding property between the heater 111 and the inner surface of the fixing sleeve 113. The fluorine-based grease is used because of a reason that temperature of the interface between the heater 111 and the fixing sleeve 113 becomes high temperature of approximately 180 degrees centigrade when the unfixed toner image T is fixed. Even at such the high temperature as described above, the fluorine-based grease has an advantage of high resistance against heat and deterioration. The resistance heating element of the heater 111 is supplied with electric power from power control means (not shown). The electric power enables the resistance heating element to generate heat so that the heater 111 raises its temperature and heats the fixing sleeve 113.

The temperature control thermistor 116 detects temperature of the heater 111, and the detection signal is fetched by the power control means. The power control means controls the power supply to the heater 111 on the basis of the detection signal so that temperature of the heater 111 is maintained at a predetermined temperature (target temperature).

When the rotation of the pressure roller 115 and the fixing sleeve 113 becomes stable and temperature of the heater 111 is maintained at a predetermined temperature, the recording material S bearing an unfixed toner image T is conveyed in the arrow direction and is lead to the nip portion N. The recording material S is pinched between the surface of the pressure roller 115 and the surface of the fixing sleeve 113 at the nip portion N and is conveyed by them at a speed of 47 mm/sec. In the conveying process, heat of the fixing sleeve 113 and pressure of the nip portion N are applied to the recording material S, and hence the toner image T is fixed onto the recording material S by the heat fixing process.

(Fixing Sleeve (Flexible Sleeve for the Fixing Apparatus))

Figure 12A:
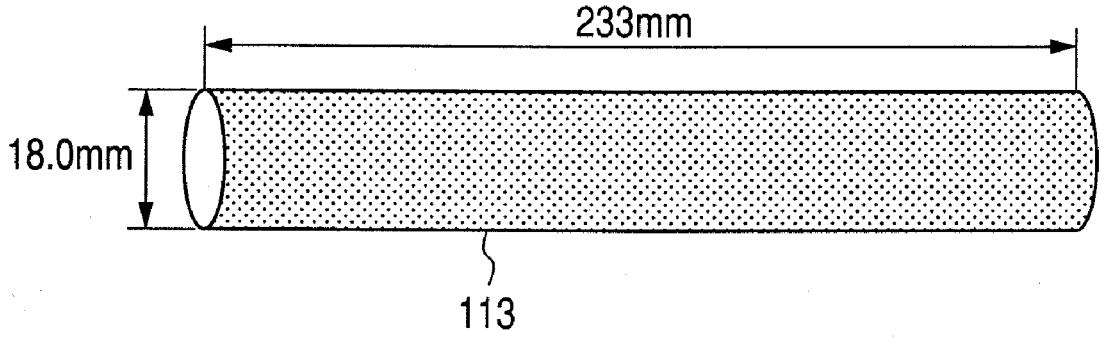
FIG. 12A is an explanatory diagram of the fixing sleeve.
Figure 12B:
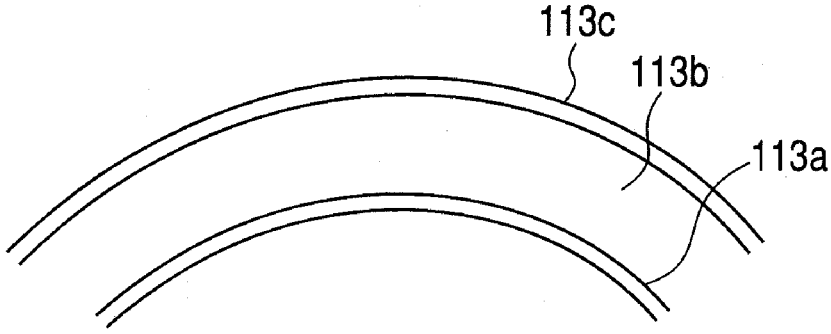
FIG. 12B is a diagram illustrating a part of a cross section of the fixing sleeve.

FIGS. 12A and 12B are explanatory diagrams of the fixing sleeve 113.

As illustrated in FIG. 12A, the fixing sleeve 113 is a cylindrical film having a longitudinal dimension of 233 mm, an inner diameter of 18.0 mm, and flexibility. In addition, the fixing sleeve 113 includes a stainless steel film (stainless steel layer) 113*a*, a rubber layer 113*b*, a fluororesin layer (surface layer made of a fluororesin tube) 113*c* formed in this order from the inside as illustrated in FIG. 12B as an enlarged cross section. In other words, the outer periphery of the cylindrical stainless steel film 113*a* is provided with a rubber layer 113*b* as the elastic layer for covering the stainless steel film 113*a*. Further, the outer periphery of the rubber layer 1*b* is coated with a resin tube as the surface layer 1*c* for covering the rubber layer 1*b*. In other words, the elastic layer is covered with the resin tube as the surface layer. This fixing sleeve 113 has thermal capacity per unit area of approximately 0.1 $J/cm^2 \cdot K$, and such the fixing apparatus 113 as described above is used.

Next, a method of covering the fluororesin tube as for the fixing sleeve 113 is described.

The method of covering the fluororesin tube over the sleeve 42 (see FIG. 13B) including the elastic layer (rubber layer) 1*b* formed on the surface of the cylindrical stainless steel film 113*a* is basically the same as the case of the roller 32 described in Embodiment 1. The sleeve 42 is different from the roller 32 in the shape of the core bar and the thickness of the rubber layer.

FIGS. 13A to 13C and 14A to 14C are diagrams for illustrating methods of manufacturing the fixing sleeve.

Figure 13A:
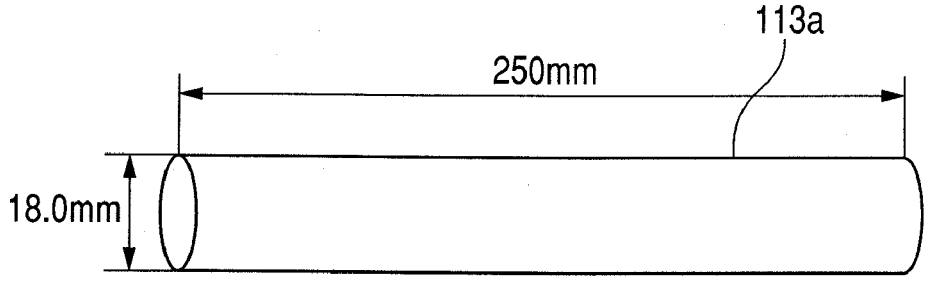
FIG. 13A is a first diagram (1) illustrating a method of manufacturing the fixing sleeve.
Figure 13B:
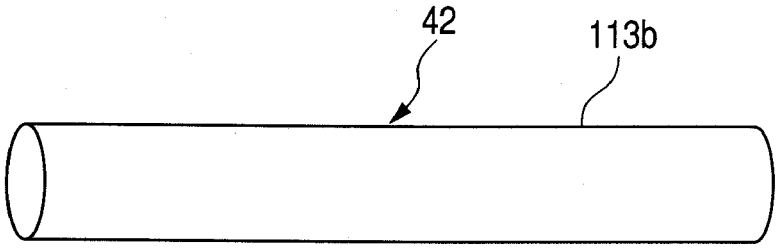
FIG. 13B is a first diagram (2) illustrating a method of manufacturing the fixing sleeve.
Figure 13C:
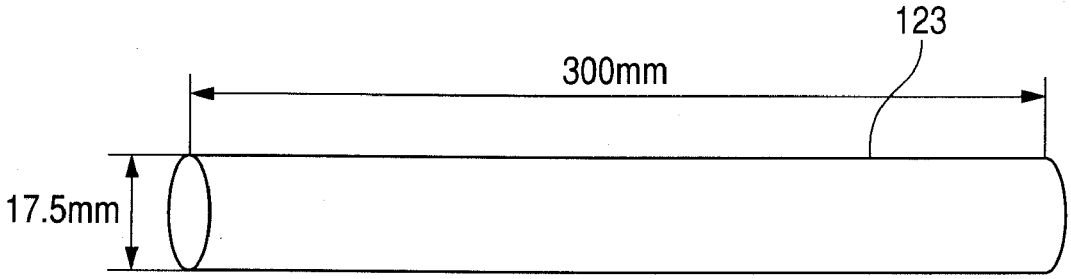
FIG. 13C is a first diagram (3) illustrating a method of manufacturing the fixing sleeve.

First, the outer peripheral surface (surface) of the cylindrical stainless steel film 113*a* having a longitudinal length of 250 mm, an outer diameter of 18 mm, and a thickness of 30 microns illustrated in FIG. 13A is cleaned with a solvent, and a primer process is performed thereon. Then, hot vulcanization (HTV) type silicone rubber is coated on the surface of the cylindrical stainless steel film 113*a* by ring coating, and the silicone rubber is heated and cured so as to obtain the sleeve 42 having the rubber layer (elastic layer) 113*b* of a straight cylindrical shape (FIG. 13B). The thickness of the rubber layer 113*b* is set to be 200 microns. A cylindrical fluororesin tube 123 illustrated in FIG. 13C has an inner diameter of 17.5 mm and a length of 300 mm in the axial direction. The method of covering the fluororesin tube 123 is the same as Embodiment 1.

More specifically, the sleeve 42 includes the elastic layer 1*b* formed on the surface of the cylindrical stainless steel film 113*a*, and the fluororesin tube 123 having a thickness of 20 microns and the inner diameter smaller than the outer diameter of the sleeve 42 is expanded in the radial direction of the fluororesin tube 123 so that the fluororesin tube 123 can cover the sleeve 42.

Figure 14A:
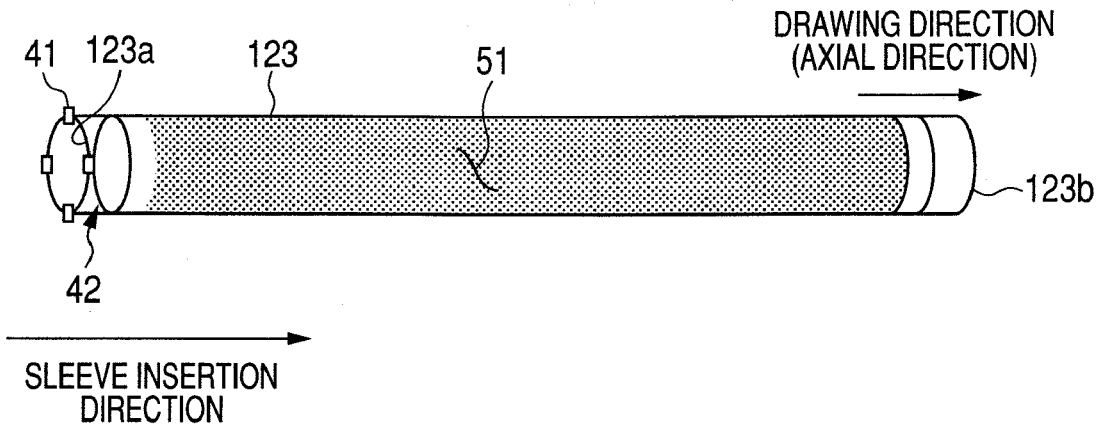
FIG. 14A is a second diagram (1) illustrating a method of manufacturing the fixing sleeve.
Figure 14B:
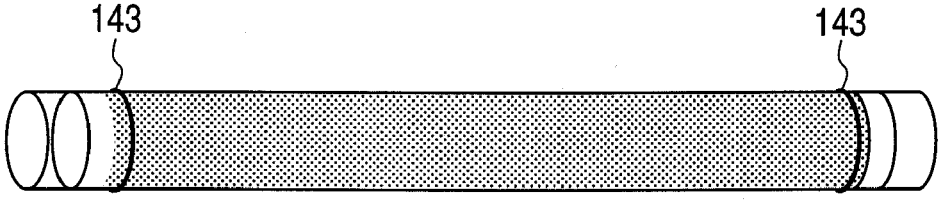
FIG. 14B is a second diagram (2) illustrating a method of manufacturing the fixing sleeve.
Figure 14C:
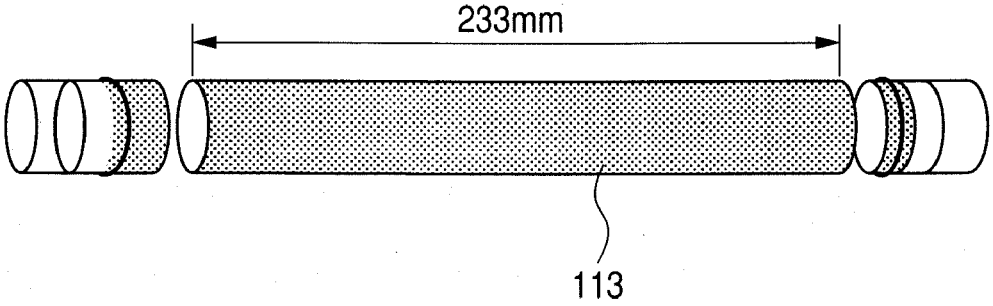
FIG. 14C is a second diagram (3) illustrating a method of manufacturing the fixing sleeve.

As illustrated in FIG. 14A, the fluororesin tube 123 is formed to have a redundant length on both ends in the axial direction (hereinafter, also referred to as generatrix direction) of the sleeve 42 and is put over the sleeve on which the rubber layer is formed. The step of covering the tube over the sleeve is performed by the same method as the step of covering the fluororesin tube over the rubber layer of the fixing roller as described above. Then, one end portion 123*a* of the tube 123 is fixed with the chuck 41. In this state, the other end 123*b* of the tube 123 is pulled by 15.0 mm in the generatrix direction of the sleeve 42 from the opposite direction to the chuck 41, and hence the wrinkle 51 generated on the outer peripheral surface (surface) of the tube 123 is smoothed. In the axial drawing step, the pulling amount 15.0 mm of the fluororesin tube 123 corresponds to 5% of the longitudinal length of the fluororesin tube 123 that is 300 mm. Next, as illustrated in FIG. 14B, the both redundant end portions 143 of the fluororesin tube 123 are welded by heat, and the adhesive is cured by heating for five minutes at 200 degrees centigrade. At the end, the redundant portions of the fixing sleeve are cut so that the fixing sleeve 113 having a predetermined length is obtained as illustrated in FIG. 14C.

Thus, in the above-mentioned axial drawing step, the resin tube 123 is drawn in the generatrix direction of the sleeve 42 so that the wrinkle 51 generated on the surface of the resin tube 123 is smoothed. The drawing ratio of the resin tube 123 is 5%. The drawing ratio is calculated as "(((resin tube length after drawing)−(resin tube length before drawing))/resin tube length before drawing)×100(%)".

(Fluororesin Tube)

The method of manufacturing the fluororesin tube 123 that is used for the flexible fixing sleeve 113 is basically the same as the method of manufacturing the fluororesin tube 33 of Embodiment 1. Comparing with the method of manufacturing the fluororesin tube 33 of Embodiment 1, the method of manufacturing the fluororesin tube 123 of this example is different only in the diameter for sizing the fluororesin tube 123. More specifically, in the extruding step, the die 65 has die/mandrel diameters of 26 mm/22 mm. PFA extruded from the die 65 in a tube-like shape enters the sizing die 67 having an outer diameter of 17.5 mm so as to be sized as a cylindrical member having a thickness of 20 microns and an outer diameter of 17.5 mm. Other than that, the material of the fluororesin, the melting temperature, the taking off speed, and the like are the same as the manufacturing method of Embodiment 1.

(Relationship Between Crack in Fluororesin Layer of Fixing Roller and Image Defect)

Next, a "crack in the fluororesin layer (surface layer)" is described with reference to FIG. 15.

Figure 15:
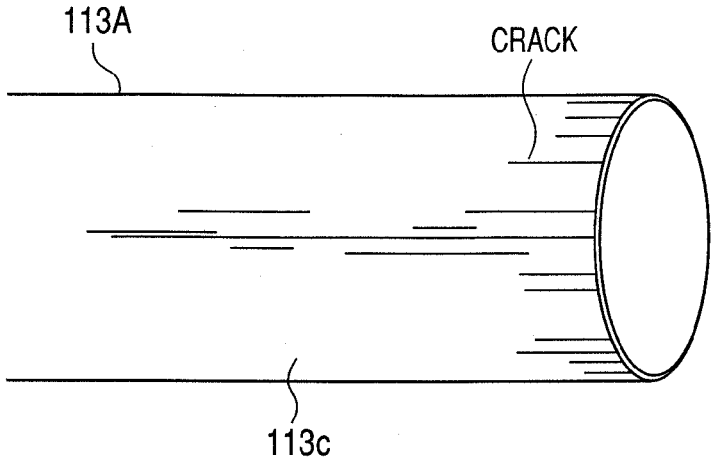
FIG. 15 is a diagram illustrating a fixing sleeve having a crack generated in a fluororesin layer.

FIG. 15 is a diagram illustrating an end portion of the fixing sleeve having a crack generated in a fluororesin layer 113*c* serving as the surface layer. For discrimination from the fixing sleeve 113 of this embodiment, the fixing sleeve illustrated in FIG. 15 is denoted by reference symbol 113A. The fixing sleeve 113A illustrated in FIG. 15A has the same structure as that of the fixing sleeve 113 of this embodiment except for a crack generated in the fluororesin layer 113*c*.

An occurrence situation of the crack that occurs in the fluororesin layer 113*c* of the fixing sleeve 113A is a little different about the occurrence position from the occurrence situation of the crack in the fixing roller 1A of the Example 1. In other words, as to the fixing sleeve 113A, the crack is apt to occur at the end portion of the fixing sleeve 113 where adhesion amount of the fluorine-based grease is large.

Figure 16:
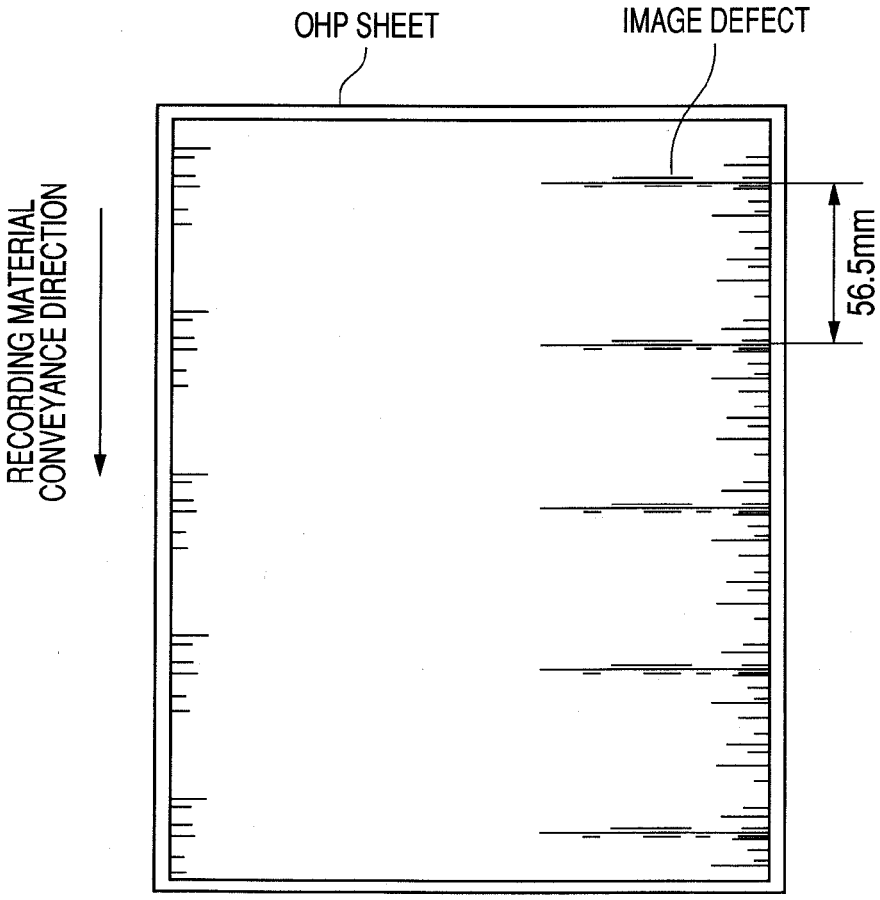
FIG. 16 is a diagram illustrating a state of occurrence of an image defect.

FIG. 16 is a diagram illustrating a state of occurrence of an image defect in an output of the image by using the image forming apparatus including the fixing apparatus F2 having the fixing sleeve 113A having a crack generated in the fluororesin layer 113*c*. An image pattern of the output image is a solid image having the entire surface filled with yellow color, and the recording material S for printing the output image is a sheet for an OHP.

The image defect printed on the OHP sheet has a thin line like a hairline generated at the position corresponding to the crack generated on both end portions of the fixing sleeve 113A, and the same pattern is repeated every rotation of the fixing sleeve 113A. The fixing sleeve 113A has an outer diameter of approximately 18 mm, and hence the pattern of the image defect is repeated every interval of one circumference 56.5 mm. As in the case of the fixing roller 1A, this thin line has a tendency of being conspicuous in a solid image or the like having much toner. In addition, this thin line becomes conspicuous in the case where glossiness of the toner surface is high or in the case where the OHP sheet that is transparent for light is used. If the fixing sleeve 113A is continuously used in the state with the thin line, the fluororesin layer (fluororesin tube 123) 113*c* is entirely ruptured so that the surface of the rubber layer 113*b* is exposed at the end. If the surface of the rubber layer 113*b* is exposed, toner adheres to the surface of the rubber layer 113*b* at the exposed portion, thereby blotting a print image to make a serious image defect.

(Causes of Occurrence of Crack on the Fluororesin Layer)

Next, it was found by the inventors of the present invention that there are three points (1), (2), and (3) described below that cause the "crack in the fluororesin layer" generated in the fluororesin layer 113*c* of the fixing sleeve 113.

(1) Orientational crystallization of the fluororesin.

(2) Mechanical stress exerted on the fluororesin layer.

(3) Fluorine-based grease adhering to the surface of the fluororesin

The orientational crystallization of the fluororesin layer described in (1) is the same as the Example 1. Therefore, the description thereof is omitted.

The mechanical stress exerted on the fluororesin layer described in (2) is described.

Figure 17A:
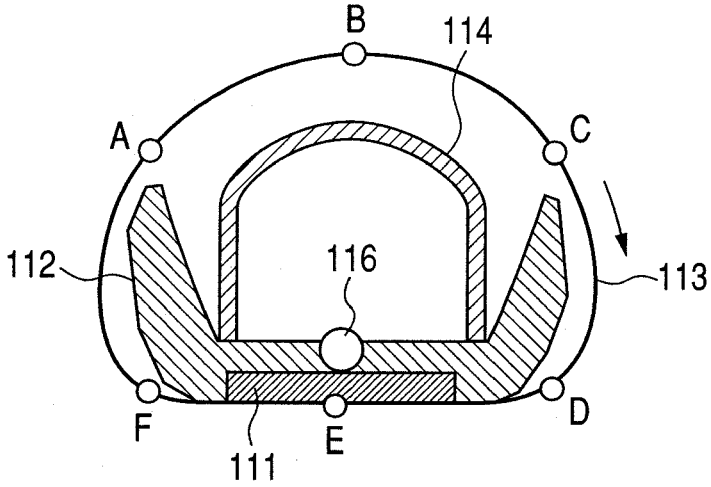
FIG. 17A is a diagram (1) illustrating a cause of occurrence of a crack in the fluororesin layer.
Figure 17B:
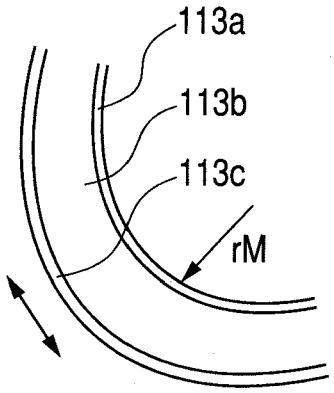
FIG. 17B is a diagram (2) illustrating a cause of occurrence of a crack in the fluororesin layer.
Figure 17C:
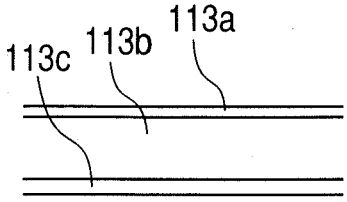
FIG. 17C is a diagram (3) illustrating a cause of occurrence of a crack in the fluororesin layer.

FIGS. 17A, 17B and 17C are diagrams illustrating a cause of occurrence of a crack in the fluororesin layer 113*c* of the fixing sleeve 113.

The fixing sleeve 113 is driven to rotate in the arrow direction around the heater holder 112 while the inner surface of the sleeve contacts with the glass coating of the heater 111 close to the substrate surface by the rotation force imparted by the pressure roller 115 and slides on the same as illustrated in FIG. 11. The shape of the fixing sleeve 113 when it is driven to rotate is such that the circular fixing sleeve 113 is pressed at the nip portion N to be flat (shape illustrated by the curve A-B-C-D-E-F in FIG. 17A).

In the cross section form of the fixing sleeve 113 illustrated in FIG. 17A, the A-B-C portion corresponding to the upward opening region of the heater holder 112 is similar to a free shape of the fixing sleeve 113 in the state of being driven to rotate, in which little stress is exerted on the fluororesin layer 113*c*.

In contrast, the F and D portions at the vicinity of the end portions in the width direction of the lower surface of the heater holder 112 follow the shapes of the end portions in the width direction of the lower surface of the heater holder 112 and are bent so as to have the minimum radius of curvature. In the fixing apparatus F2 of this embodiment, a radius of curvature of the fixing sleeve 113 at the F and D portions is defined as rM=5 mm. An enlarged cross sectional diagram of the fixing sleeve 113 at the F portion is as illustrated in FIG. 17B. In other words, the stainless steel layer 113*a*, the rubber layer 113*b* and the fluororesin layer 113*c* all follow the shape of the stainless steel layer 113*a* so as to be bent like an arch. On this occasion, the stainless steel layer 113*a* does not expand and contract since it has a Young's modulus higher than that of the rubber layer 113*b* or the fluororesin layer 113*c*, and hence the outermost fluororesin layer 113*c* expands largely. Therefore, the smaller the radius of curvature at the F and D portions, the more largely the fluororesin layer 113*c* is expanded so that the mechanical stress increases.

In the E portion at the middle in the width direction of the heater 111, the curvature becomes zero following the shape of the heater 111. Therefore, the enlarged cross sectional diagram of the fixing sleeve 113 becomes as illustrated in FIG. 17C. The stainless steel layer 113*a*, the rubber layer 113*b* and the fluororesin layer 113*c* all become flat so that a stress is exerted on the fluororesin layer 113*c* in the direction contracting oppositely from the free shape.

In addition, torque when the fixing sleeve 113 starts to rotate becomes larger than torque in the steady rotation. Therefore, the fluororesin layer 113*c* receives a large friction force when it starts to rotate, and hence it receives strong mechanical stress.

In other words, every time when the fixing sleeve 113 is rotated or starts to rotate, the stress in the dynamically-weak direction is repeated with respect to the thinned fluororesin tube 123. When this is repeated every time when the fixing sleeve 113 is rotated or starts to rotate, the fluororesin layer 113*c* is ruptured so that the crack occurs.

In the case of the fixing apparatus F2 of this embodiment, and if life of the main body of the image forming apparatus is 50,000 sheets of paper print, the number of times of starting the rotation of the fixing sleeve is 50,000 at maximum, and the number of rotations is 1,000,000 or larger at maximum. Therefore, the fluororesin layer 113*c* of the fixing roller 113 is required to have high flex strength.

Next, the fluorine-based grease adhering to the fluororesin surface as illustrated in (3) is described.

In the fixing apparatus F2 of this embodiment, the heater 111 becomes high temperature of 180 degrees centigrade or higher when it is activated. On this occasion, the fluorine-based grease applied onto the inner surface of the fixing sleeve 113 is heated so that its flowability is improved. When the fixing sleeve 113 is rotated repeatedly in the heated state, the fluorine-based grease overflows from the end portion of the fixing sleeve 113 by a very tiny amount so as to pass through the nip portion N by capillarity, and a tiny amount of the fluorine-based grease circles around to the surface of the fixing sleeve 113. Then, it adheres to the fluororesin layer 113*c* of the fixing sleeve. The fluorine-based grease penetrates between fluororesin polymer spherulites of the fluororesin layer 113*c* and causes a chemical reaction so as to promote deterioration of the fluororesin layer 113*c*. If the deterioration of the fluororesin layer 113*c* is promoted, a crack may occur on the surface of the fluororesin layer 113*c*

(surface of fixing sleeve 113) by the stress exerted repeatedly while the fixing sleeve 113 rotates.

(Evaluation)

In order to check the effect of the image forming apparatus equipped with the fixing apparatus F2 including the fixing sleeve 113 according to this embodiment, toner fixability (indicator of efficiency of heat conduction to toner) and the presence or absence of occurrence of the crack after the endurance (indicator of endurance of fixing sleeve) are evaluated with the measurement of the crystallization degree. Further in this example, an "accelerated test using the fluorine-based grease" is also performed concerning the crack in the fluororesin layer 113*c* of the fixing sleeve 113.

(Evaluation Method of Accelerated Test Using Fluorine-Based Grease)

This evaluation is aimed at performing accelerated evaluation concerning occurrence of a crack when the fluorine-based grease adheres to the fluororesin layer surface of the fixing sleeve 113 and penetrates between fluororesin polymer spherulites so as to promote deterioration.

Methods for acceleration include including adhesion amount of the fluorine-based grease, raising temperature so as to promote chemical reaction, decreasing a radius of curvature of the fixing sleeve so as to increase mechanical stress in the fluororesin layer. In this case, the enlarged cross sectional diagram of the fixing sleeve becomes as illustrated in FIG. 17B, in which all the stainless steel layer 113*a*, the rubber layer 113*b* and the fluororesin layer 113*c* follow the shape of the stainless steel layer 113*a*, bend like an arch, and hence the outermost fluororesin layer 113*c* is expanded largely.

A concrete method is described with reference to FIGS. 18A and 18B.

Figure 18A:
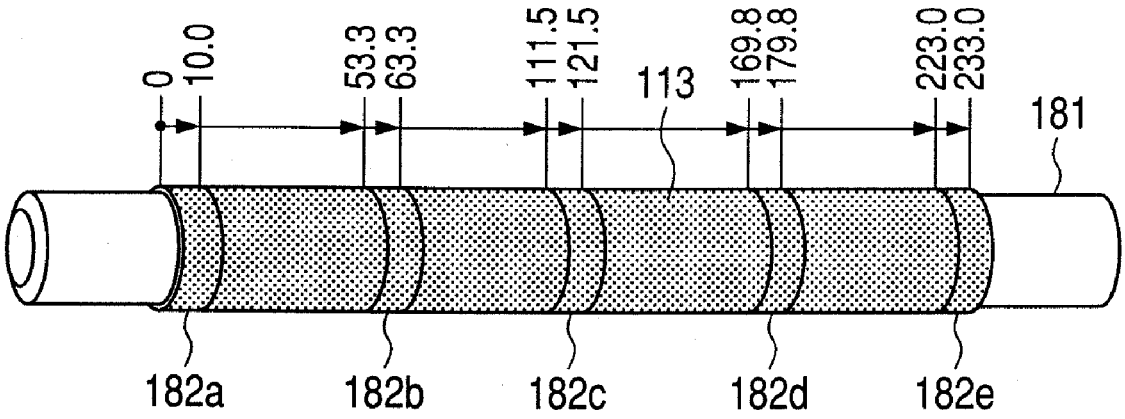
FIG. 18A is an explanatory diagram (1) of a method of an accelerated test using fluorine-based grease.
Figure 18B:
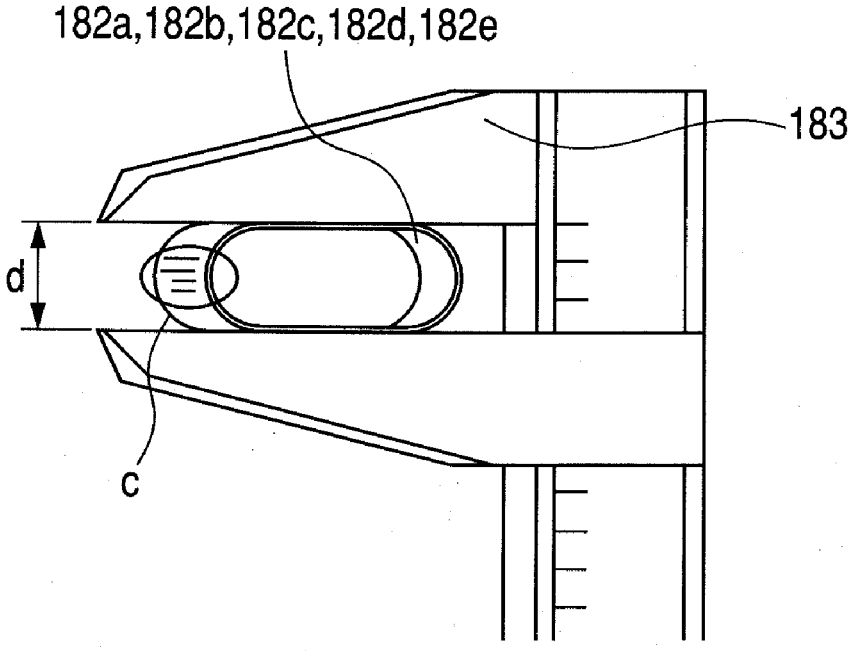
FIG. 18B is an explanatory diagram (2) of a method of an accelerated test using fluorine-based grease.

FIGS. 18A and 18B are explanatory diagrams of an accelerated test using the fluorine-based grease.

First, in order to prevent the fixing sleeve 113 from being deformed during the work, a stainless steel rod 181 (hereinafter referred to as a core) having a diameter of ϕ17.9 mm is inserted into the fixing sleeve. In this state, the fixing sleeve 113 is cut in the circumferential direction at eight positions. The cutting positions are 10.0 mm, 53.3 mm, 63.3 mm, 111.5 mm, 121.5 mm, 169.8 mm, 179.8 mm and 223.0 mm from the end portion as illustrated in FIG. 18A. The fluorine-based grease (MOLYKOTE HP-300 grease manufactured by Dow Corning Toray Co., Ltd.) is applied onto the entire area of the outer peripheral surface of sleeve pieces 182*a*, 182*b*, 182*c*, 182*d* and 182*e* cut into widths of 10 mm. The sleeve piece to which the fluorine-based grease is applied is drawn out from the core, and in this state the sleeve piece is heated at a temperature of 200 degrees centigrade in a thermostatic oven for five minutes. Then, it is taken out from the thermostatic oven and is cooled at room temperature for one hour or longer. Next, the fluorine-based grease on the surface of the cooled sleeve piece is cleaned with neutral detergent. In this case, the sleeve piece is inserted in the core to be cleaned so that the sleeve piece is not deformed.

Next, as illustrated in FIG. 18B, using a vernier caliper 183 so as to pinch the sleeve piece, the portion C with a highest curvature in the fluororesin layer of the sleeve piece is observed visually so that the presence or absence of occurrence of a crack is confirmed. When the occurrence of a crack is observed visually, a magnifying glass with fluorescent lighting or the like is used. After the visual observation, the space d is decreased by 1 mm. This is repeated until occurrence of a crack as illustrated in the drawing at the portion C. Then, a value of the space d (mm) when a crack has occurred is defined to be the radius of curvature when a crack has occurred. The operation is performed one time for each of the sleeve pieces 182*a*, 182*b*, 182*c*, 182*d* and 182*e* so that a maximum value among the five points is used. If no crack has occurred even if the sleeve piece is squeezed completely, it is defined that d=0 mm. If the fluororesin layer has endurance property so that a crack is less likely to occur, the value of the space d becomes small. On the contrary, if the fluororesin layer does not have endurance property so that a crack is apt to occur, the value of the space d becomes large.

<Evaluation Result>

Hereinafter, the samples of the embodiments and the comparison examples used for the evaluation are described in detail.

Total seventeen types of samples were manufactured. The details are omitted because the samples are the same as those of the embodiment 1.

As to a tube thickness of 15 microns, the axial drawing quantity (%) such that the wrinkle can be smoothed appropriately in the manufacturing process was 10%. Therefore, the manufactured samples include five types of 2%, 3%, 4%, 6%, and 10%.

As to a tube thickness of 20 microns, the axial drawing quantity (%) such that the wrinkle can be smoothed appropriately in the manufacturing process was 8%. Therefore, the manufactured samples include seven types of 1%, 2%, 3%, 4%, 5%, 6%, and 8%.

As to a tube thickness of 25 microns, the axial drawing quantity (%) such that the wrinkle can be smoothed appropriately in the manufacturing process was 5%. Therefore, the manufactured samples include three types of 1%, 3%, and 5%.

As to a tube thickness of 30 microns, the axial drawing quantity (%) such that the wrinkle can be smoothed appropriately in the manufacturing process was 4%. Therefore, the manufactured samples include two types of 2% and 4%.

Detailed setting of total seventeen types of samples, and the fixability evaluation result and the endurance property evaluation result thereof are illustrated in Table 2. The samples from Embodiment 2-1 to Embodiment 2-7 have thicknesses of the resin tube of 20 microns or smaller and crystallization degrees of the resin tube of 50% or smaller. The samples from Comparison Example 2-1 to Comparison Example 2-10 have thicknesses of the resin tube of 20 microns or larger, or crystallization degrees of 50% or larger.

TABLE 2

| | taking off speed (m/min) | tube thickness (μm) | axial direction drawing (%) | crystallization degree (%) | fixability (%) | result of endurance |
|---|---|---|---|---|---|---|
| Embodiment 2-1 | 5.0 | 15 | 2 | 47 | 12 (acceptance) | acceptance |
| Embodiment 2-2 | 5.0 | 15 | 3 | 49 | 11 (acceptance) | acceptance |
| Comparative Example 2-1 | 5.0 | 15 | 4 | 53 | 10 (acceptance) | rejection |
| Comparative Example 2-2 | 5.0 | 15 | 6 | 56 | 12 (acceptance) | rejection |
| Comparative Example 2-3 | 5.0 | 15 | 10 | 63 | 14 (acceptance) | rejection |
| Embodiment 2-3 | 4.0 | 20 | 1 | 43 | 15 (acceptance) | acceptance |

TABLE 2-continued

| | taking off speed (m/min) | tube thickness (μm) | axial direction drawing (%) | crystallization degree (%) | fixability (%) | result of endurance |
|---|---|---|---|---|---|---|
| Embodiment 2-4 | 4.0 | 20 | 2 | 45 | 14 (acceptance) | acceptance |
| Embodiment 2-5 | 4.0 | 20 | 3 | 47 | 18 (acceptance) | acceptance |
| Embodiment 2-6 | 4.0 | 20 | 4 | 48 | 17 (acceptance) | acceptance |
| Embodiment 2-7 | 4.0 | 20 | 5 | 49 | 16 (acceptance) | acceptance |
| Comparative Example 2-4 | 4.0 | 20 | 6 | 53 | 13 (acceptance) | rejection |
| Comparative Example 2-5 | 4.0 | 20 | 8 | 55 | 15 (acceptance) | rejection |
| Comparative Example 2-6 | 3.2 | 25 | 1 | 41 | 23 (rejection) | acceptance |
| Comparative Example 2-7 | 3.2 | 25 | 3 | 45 | 22 (rejection) | acceptance |
| Comparative Example 2-8 | 3.2 | 25 | 5 | 47 | 25 (rejection) | acceptance |
| Comparative Example 2-9 | 2.7 | 30 | 2 | 42 | 30 (rejection) | acceptance |
| Comparative Example 2-10 | 2.7 | 30 | 4 | 45 | 29 (rejection) | acceptance |

As to the fixability of the tube thickness of 15 microns and the 20 microns, the evaluation of the fixability (i.e., the ratio of density decrease) is smaller than 20(%), and the conclusion is "acceptance". As to the tube thickness of 25 microns and that of 30 microns, the evaluation of the fixability (i.e., ratio of density decrease) is larger than 20(%), and the conclusion is "rejection". In other words, it indicates that the efficiency of heat conduction to the toner is improved by making the tube thin.

The "acceptance" and the "rejection" concerning the endurance property indicate results of the durability test. The result "acceptance" indicates that a crack did not occur in the fluororesin layer (i.e., the surface layer of the fixing sleeve) during the life of the image forming apparatus. The result "rejection" indicates that a crack occurred. According to the results, the samples from the Embodiment 2-1 to the Embodiment 2-7 satisfy both the "acceptance" concerning the fixability and the "acceptance" concerning the endurance property.

Figure 19:
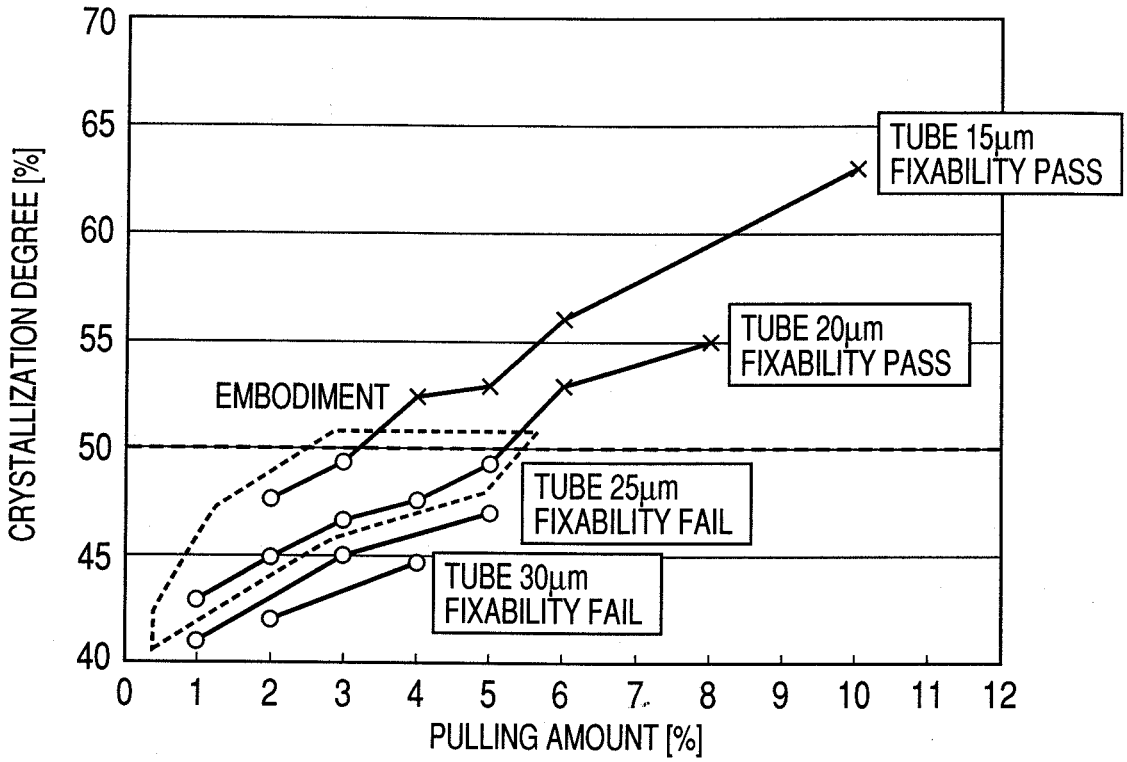
FIG. 19 is a graph illustrating evaluation results of fluororesin tube samples.

FIG. 19 illustrates a graph of the results. The horizontal axis of the graph indicates a pulling amount (%) of the fluororesin tube in the axial drawing step, and the vertical axis of the graph indicates a crystallization degree (%). The plot lines are classified by the tube thicknesses of 15 microns, 20 microns, 25 microns, and 30 microns for convenience sake.

In FIG. 19, each of the lines concerning the tube thicknesses of 15 microns, 20 microns, 25 microns, and 30 microns indicates a tendency of monotonic increase, i.e., a tendency in which the crystallization degree increases as the fluororesin tube is pulled more in the axial drawing step. In addition, it is understood that there is a tendency of the crystallization degree increasing as the drawing magnification is increased so as to make the fluororesin tube thin.

It is understood from this evaluation result that control of the orientational crystallization of the fluororesin so as to make the fixing sleeve having the crystallization degree of 50% or smaller is effective for preventing occurrence of the crack in the fluororesin layer.

As to the fixing sleeve 113 of this embodiment, a concrete method of controlling the crystallization degree to be 50% or smaller is to control the pulling amount of the fluororesin tube 123 in the axial drawing step to be 5% or smaller in a case of a tube thickness of 20 microns. Furthermore, in a case of a tube thickness of 15 microns, the method is to control the pulling amount of the fluororesin tube 123 in the axial drawing step to be 3% or smaller.

In addition, it is desirable to control the crystallization degree to be within the range of 43 to 50% if it is considered sufficiently to suppress the occurrence of a wrinkle on the tube.

Furthermore, in order to control the crystallization degree to be 50% or smaller while suppressing occurrence of a wrinkle on the tube, it is desirable to control the pulling amount of the fluororesin tube 33 in the axial drawing step to be within the range of 1% to 5% in the case of the tube thickness of 20 microns. In addition, it is desirable to control the pulling amount of the fluororesin tube 33 in the axial drawing step to be within the range of 2% to 3% in the case of the tube thickness of 15 microns.

Note that though the drawing ratio in the appropriate axial drawing step for controlling the crystallization degree of the tube to be 50% or smaller while suppressing a wrinkle depends on a difference of the fluororesin tube other than the thickness, the suppression of a wrinkle and the control of the crystallization degree to be substantially within an appropriate range can be achieved if the drawing ratio is set to be within the range of 1% to 5% in the case of the fluororesin tube having the thickness of 20 microns or smaller.

As described above, a good fixability can be obtained by controlling the thickness of the resin tube 123 to be 20 microns or smaller, and occurrence of the crack in the fluororesin layer 113 through the endurance can be prevented by controlling the crystallization degree to be 50% or smaller. Therefore, the fixing sleeve having both high heat conduction efficiency and high endurance property can be provided.

In addition, the accelerated test using the fluorine-based grease was performed under the condition of the tube thickness of 15 microns for five axial drawing amounts of 2%, 3%, 4%, 6% and 10% as well as the tube thickness of 20 microns for seven axial drawing amounts (%) of 1%, 2%, 3%, 4%, 5%, 6% and 8%.

Figure 20:
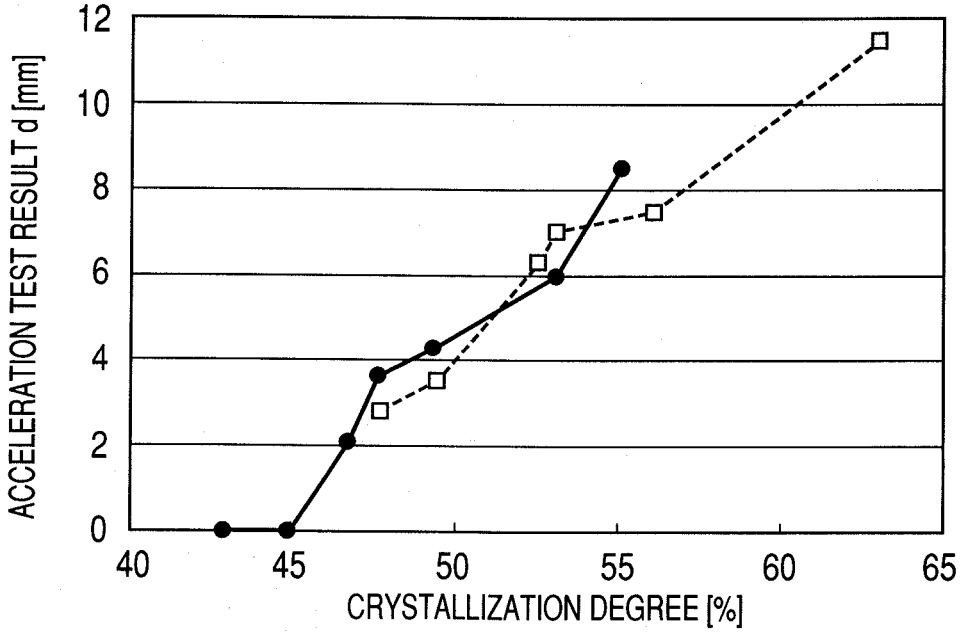
FIG. 20 is a graph illustrating evaluation results of the accelerated test using fluorine-based grease.

A result of the evaluation is illustrated in FIG. 20. The horizontal axis of the graph indicates a crystallization degree (%), and the vertical axis of the graph indicates a result d (mm) of the acceleration test. As for the plotted lines, the solid line corresponds to the tube thickness of 20 microns, and the broken line corresponds to the tube thickness of 15 microns.

In FIG. 20, each of the lines corresponds to the tube thicknesses 20 microns and 15 microns has a tendency of monotonic increase. In other words, the larger the crystallization degree, the more the crack in the fluororesin is apt to occur so that the distance of d increases. If the crystallization degree is 45% or smaller, no tube crack has occurred in the state of d=0. According to this result, it is understood that a crack becomes less likely to occur in the fluororesin layer when the crystallization degree is decreased.

According to the data described above, it is understood that if the structure of the fixing apparatus is changed, a value of the crystallization degree necessary for the fluororesin layer changes. More specifically, depending on a value of the minimum radius of curvature rM of the fixing sleeve, the values change as examples in (1), (2) and (3) described below.

(1) In the fixing apparatus F2 illustrated in this embodiment, for instance, the fixing sleeve 113 becomes to have a minimum radius of curvature at the portions F and D as illustrated in FIG. 17B, and the value thereof is rM=5 mm. In general, as for a fixing apparatus forming a nip portion having a width of a few millimeters using a fixing sleeve having a diameter of approximately 30ϕ to 18ϕ and a flat heater, a minimum radius of curvature rM becomes a value within the range of 3 to 6 mm. If the value rM is within the range of 3 to 6 mm, it is necessary that no fracture occurs if the value of the accelerated test result d is within the range of d=rM×2=6 to 12 mm. Therefore, it is desirable that the crystallization degree should be 50% or smaller since it is necessary to achieve d=6 mm or smaller.

(2) If the minimum radius of curvature rM of the fixing sleeve is 6 mm or larger, it is necessary that no fracture occurs when the value of the accelerated test result d is rM×2=12 mm. Therefore, the value d can be 12 mm or smaller, and the crystallization degree can be 60% or smaller. However, concerning the structure of the fixing apparatus, if rM is 6 mm or larger, it is necessary to take means of increasing a diameter of the fixing sleeve, increasing dimensions of the fixing apparatus, decreasing a width of the nip or other means.

(3) In the fixing apparatus, if the minimum radius of curvature of the fixing sleeve is decreased on the downstream of the nip (at the vicinity of the F portion of FIG. 17A), there is a merit that the toner is less likely to remain on the fluororesin layer resulting in little occurrence of the image defect. Utilizing this merit, a toner image with higher image quality can be obtained. If the crystallization degree is 45% or smaller, no fracture occurs even if the value of the accelerated test result d is 0 mm. Therefore, the fluororesin layer can endure even an extremely small curvature. Thus, flexibility in designing the fixing apparatus increases, which is more desirable. Means for achieving the crystallization degree of 45% or smaller include a method of increasing melting temperature when the fluororesin tube is molded so that the orientation is reduced, a method of changing conditions for injecting the melted fluororesin so as to decrease the drawing magnification and reduce the orientation. However, if the crystallization degree becomes 40% or smaller, the fluororesin tube becomes soften so as to have a tendency of having a hole or being difficult in forming the same. Therefore, it is desirable that the crystallization degree is within the range of 40% to 45%.

As described above, a value of the crystallization degree of the fluororesin tube that is necessary for the fluororesin layer is different depending on the structure of the fixing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-189399, filed Jul. 20, 2007, which is hereby incorporated by reference herein in its entirety.

What is claimed is:

1. A fixing apparatus comprising:

a roller for the fixing apparatus comprising a base layer, a rubber layer formed on the base layer and a surface layer formed of a fluororesin tube;

a heater disposed inside the roller for the fixing apparatus; and a pressure roller for forming a fixing nip portion for pinching and conveying a recording material bearing a toner image with the roller for the fixing apparatus, wherein the surface layer of the roller for the fixing apparatus is formed by covering the fluororesin tube on the rubber layer in a condition where the fluororesin tube is pulled in a radial direction of the fluororesin tube, the fluororesin tube has an internal diameter less than an outer diameter of the roller in a condition where the rubber layer is formed on the base layer but the fluororesin tube is not covered and a thickness of 20 microns or smaller and a crystallization degree of the fluororesin tube being 50% or smaller.

2. A fixing apparatus according to claim 1, wherein the crystallization degree is equal to or more than 43% to equal to or less than 50%.

3. A roller for a fixing apparatus comprising a base layer, a rubber layer formed on the base layer and a surface layer formed of a fluororesin tube, wherein the surface layer of the roller for the fixing apparatus is formed by covering the fluororesin tube on the rubber layer in a condition where the fluororesin tube is pulled in a radial direction of the fluororesin tube, the fluororesin tube has an internal diameter less than an outer diameter of the roller in a condition where the rubber layer is formed on the base layer but the fluororesin tube is not covered and a thickness of 20 microns or smaller and a crystallization degree of the fluororesin tube being 50% or smaller.

4. A fixing apparatus according to claim 3, wherein the crystallization degree is equal to or more than 43% to equal to or less than 50%.

5. A method of manufacturing a roller for a fixing apparatus comprising a base layer, a rubber layer formed on the base layer, a surface layer formed of a fluororesin tube, the surface layer having a thickness of 20 microns or smaller and a crystallization degree of 50% or smaller, the method comprising:

covering a rubber roller having the rubber layer formed on the base layer with a fluororesin tube having a thickness of 20 microns or smaller and an inner diameter smaller than an outer diameter of the rubber roller having the rubber layer in a state where the fluororesin tube is expanded in a radial direction; and drawing the fluororesin tube covering the roller having the rubber layer in a generatrix direction thereof, wherein a drawing ratio of the fluororesin tube in the drawing the fluororesin tube in the generatrix direction is 5% or smaller.

6. A method of manufacturing a roller for a fixing apparatus according to claim 5, wherein the drawing ratio is equal to or more than 1% to equal to or less than 5%.

7. A fixing apparatus comprising:

a flexible sleeve comprising a base layer, a rubber layer formed on the base layer and a surface layer formed of a fluororesin tube;

a heater contacting with an inner peripheral surface of the flexible sleeve; and a pressure roller for forming a fixing nip portion for pinching and conveying a recording material bearing a toner image with the heater through the flexible sleeve, wherein the surface layer of the flexible sleeve for the fixing apparatus is formed by covering the fluororesin tube on the rubber layer in a condition where the fluororesin tube is pulled in a radial direction of the fluororesin tube, the fluororesin tube having an internal diameter less than an outer diameter of the flexible sleeve in a condition where the rubber layer is formed on the base layer but the fluororesin tube is not covered and having a thickness of 20 microns or smaller and a crystallization degree of the fluororesin tube being 50% or smaller.

8. A fixing apparatus according to claim 7, wherein the crystallization degree is equal to or more than 43% to equal to or less than 50%.

9. A flexible sleeve for a fixing apparatus comprising a base layer, a rubber layer formed on the base layer, and a surface layer formed of a fluororesin tube, wherein the surface layer of the flexible sleeve for the fixing apparatus is formed by covering the fluororesin tube on the rubber layer in a condition where the fluororesin tube is pulled in a radial direction of the fluororesin tube, the fluororesin tube having an internal diameter less than an outer diameter of the flexible sleeve in a condition where the rubber layer is formed on the base layer but the fluororesin tube is not covered and having a thickness of 20 microns or smaller and a crystallization degree of the fluororesin tube being 50% or smaller.

10. A flexible sleeve for a fixing apparatus according to claim 9, wherein the crystallization degree is equal to or more than 43% to equal to or less than 50%.

11. A method of manufacturing a flexible sleeve for a fixing apparatus comprising a base layer, a rubber layer formed on the base layer, a surface layer formed of a fluororesin tube, the surface layer having a thickness of 20 microns or smaller and a crystallization degree of 50% or smaller, the method comprising:

covering a rubber sleeve having the rubber layer formed on the base layer with a fluororesin tube having a thickness of 20 microns or smaller and an inner diameter smaller than an outer diameter of a rubber sleeve having the rubber layer in a state where the fluororesin tube is expanded in the radial direction; and drawing the fluororesin tube covering a rubber sleeve having the rubber layer in a generatrix direction thereof, wherein a drawing ratio of the fluororesin tube in the drawing the fluororesin tube in the generatrix direction is 5% or smaller.

12. A method of manufacturing a flexible sleeve for a fixing apparatus according to claim 5, wherein the drawing ratio is equal to or more than 1% to equal to or less than 5%.

* * * * *